US012006780B2

(12) United States Patent
Murphy

(10) Patent No.: US 12,006,780 B2
(45) Date of Patent: Jun. 11, 2024

(54) SYSTEMS, DEVICES AND METHODS FOR ORIENTING A PRODUCTION OUTLET OF A SUBSEA PRODUCTION TREE

(71) Applicant: FMC Technologies, Inc., Houston, TX (US)

(72) Inventor: Richard Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 32 days.

(21) Appl. No.: 17/819,856

(22) Filed: Aug. 15, 2022

(65) Prior Publication Data

US 2022/0389783 A1 Dec. 8, 2022

Related U.S. Application Data

(62) Division of application No. 17/050,035, filed as application No. PCT/US2018/029522 on Apr. 26, 2018, now Pat. No. 11,421,501.

(51) Int. Cl.

| | |
|---|---|
| ***E21B 23/00*** | (2006.01) |
| ***E21B 33/035*** | (2006.01) |
| ***E21B 33/04*** | (2006.01) |

(52) U.S. Cl.

CPC ..... *E21B 33/0415* (2013.01); *E21B 23/00* (2013.01); *E21B 33/035* (2013.01)

(58) Field of Classification Search

CPC ..... E21B 33/0415; E21B 33/035; E21B 23/00
See application file for complete search history.

(56) References Cited

U.S. PATENT DOCUMENTS

| | | | | |
|---|---|---|---|---|
| 5,503,230 | A * | 4/1996 | Osborne | E21B 33/0407 166/344 |
| 5,732,773 | A * | 3/1998 | Parks | E21B 23/12 166/117.5 |
| 5,975,210 | A * | 11/1999 | Wilkins | E21B 33/038 166/341 |
| 6,231,265 | B1 * | 5/2001 | Rytlewski | E21B 17/02 166/341 |
| 6,695,355 | B1 * | 2/2004 | Giuffre | F16L 47/041 285/245 |
| 9,169,699 | B2 * | 10/2015 | Rytlewski | E21B 17/06 |
| 11,015,412 | B2 * | 5/2021 | Robottom | E21B 33/047 |
| 11,180,968 | B2 * | 11/2021 | Mitchell | E21B 33/043 |
| 2010/0263876 | A1 * | 10/2010 | Frazier | E21B 33/134 166/123 |
| 2011/0226474 | A1 * | 9/2011 | Hernandez | E21B 29/005 166/55.6 |

(Continued)

*Primary Examiner* — Aaron L Lembo

(74) *Attorney, Agent, or Firm* — Osha Bergman Watanabe & Burton LLP

(57) ABSTRACT

One illustrative apparatus (1) disclosed herein includes a helix structure (20) that comprises at least at least one helical surface (15), a plurality of orientation slots (17) positioned around a perimeter of the helix structure, each of the orientation slots (17) being adapted to receive an orientation key (18), a component orientation slot (21) positioned adjacent a bottom end of the at least one helical surface (15) and a threaded bottom recess (43). The apparatus (1) also includes a threaded adjustable nut (30) that is adapted to be at least partially positioned in the bottom recess and threadingly coupled to the threaded bottom recess (43).

13 Claims, 17 Drawing Sheets

(56) References Cited

U.S. PATENT DOCUMENTS

| | | | | |
|---|---|---|---|---|
| 2015/0129307 | A1* | 5/2015 | Pope | E21B 47/01 175/40 |
| 2020/0056445 | A1* | 2/2020 | Hardesty | E21B 33/128 |
| 2020/0399973 | A1* | 12/2020 | Mitchell | E21B 33/0407 |

* cited by examiner

SYSTEMS, DEVICES AND METHODS FOR ORIENTING A PRODUCTION OUTLET OF A SUBSEA PRODUCTION TREE

TECHNICAL FIELD

The present disclosed subject matter generally relates to various novel systems, devices and methods for orienting a production outlet of a subsea production tree of an oil and gas well.

BACKGROUND

Typically, to produce hydrocarbon-containing fluids from a subsea reservoir, several oil and gas wells are often drilled in a pattern that spaces the wells apart from each other. Each of the wells typically comprises a Christmas or production tree that is mounted on a wellhead (i.e., high-pressure housing). The production tree contains a flowline connector or "tree connector" that is often configured horizontally and positioned off to one side of the production tree. The tree connector is connected to a production conduit such as a flowline or a jumper at the sea floor. The production conduits from the trees are typically coupled to other components, such as manifolds, templates or other subsea processing units that collect or re-distribute the hydrocarbon-containing fluids produced from the wells.

When developing the field, the operator typically radially orients the tree connector, i.e., the production outlet of each of the trees, in a desired target radial orientation relative to an x-y grid of the subsea production field that includes the locations of one or more wells and the various pieces of equipment that have been or will be positioned on the sea floor. Such orientation is required to, among other things, facilitate the construction and installation of the subsea flowlines and jumpers, and to insure that the flow lines and/or jumpers are properly positioned relative to all of the other equipment positioned on the sea floor.

A typical subsea wellhead structure has a high pressure wellhead housing secured to a low-pressure housing, such as a conductor casing. The wellhead structure supports various casing strings that extend into the well. One or more casing hangers are typically landed in a high-pressure wellhead housing, with each casing hanger being located at the upper end of a string of casing that extends into the well. A string of production tubing extends through the production casing for conveying production fluids, in which the production tubing string is supported using a tubing hanger. The area between the production tubing and the production casing is referred to as the annulus.

Wells that comprise vertical completion arrangements typically plan for the tubing hanger to be landed in and supported by the wellhead. A production tree is operatively coupled to the wellhead structure so as to control the flow of the production fluids from the well. The tubing hanger typically comprises one or more passages that may include a production passage, an annulus passage and various passages for hydraulic and electric control lines. The production tree has isolation tubes that stab vertically into engagement with the various passages in the tubing hanger when the production tree lands on the wellhead. These stabbed interconnections between the tree and the tubing hanger fix the vertical spacing and relative radial orientation between the production outlet of the tree and the tubing hanger.

Since setting the radial orientation of the tubing hanger effectively sets the radial orientation of the production outlet, efforts are made to properly orient the tubing hanger within the wellhead when the tubing hanger is installed. Radial orientation of the tubing hanger is typically accomplished by using the blowout preventer (BOP) assembly for guidance. The BOP assembly typically contains an orientation pin that can be extended into the bore through the BOP. The tubing hanger is attached to running string that typically includes a tubing hanger running tool so that the tubing hanger may be installed in the wellhead. The running string also includes an orientation member, e.g., an orientation sub that typically has a helix groove formed on its outer surface that is adapted to engage the orientation pin of the BOP assembly when the orientation pin in the BOP is extended into the bore through the BOP. As the tubing hanger running tool passes through the BOP, the interaction between the BOP orientation pin and the helix groove on the orientation sub orients the tubing hanger at the proper radial orientation within the wellhead. While the use of the BOP to orient the tubing hanger is effective, such a technique requires modification of the BOP on a per field basis and sometimes on a per well basis. What is needed is a more efficient and effective means of orienting the production outlet of a production tree at a desired radial orientation relative to the field under production.

The present application is directed to various novel systems, devices and methods for orienting a production outlet of a subsea production tree that may eliminate or at least minimize some of the problems noted above.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

The present application is generally directed to various passive and active systems, devices and methods for orienting a production outlet of a subsea production tree. In one example, an apparatus disclosed herein includes a helix structure that comprise at least one helical surface, a plurality of orientation slots positioned around a perimeter of the helix structure, a component orientation slot positioned adjacent a bottom end of the at least one helical surface and a threaded bottom recess. In this example, the apparatus also includes a threaded adjustable nut that is adapted to be at least partially positioned in the bottom recess and threadingly coupled to the threaded bottom recess.

One illustrative method disclosed herein includes positioning an apparatus on a structure previously positioned in a wellhead, wherein the apparatus comprises a helix structure that includes a plurality of orientation slots positioned around a perimeter of the helix structure, a spring-loaded, outwardly-biased orientation key positioned in one of the orientation slots and a threaded bottom recess. In this example, the apparatus also includes a threaded adjustable nut that is at least partially positioned in the bottom recess and threadingly coupled to the threaded bottom recess of the helix structure. In this example, the method also includes rotating the apparatus until the spring-loaded, outwardly-biased orientation key engages an orientation recess formed on an inside of the wellhead thereby preventing further relative rotation between the helix structure and the wellhead and rotating the threaded adjustable nut relative to the helix structure so as to cause the helix structure to rise vertically within the wellhead until the helix structure is positioned at a desired vertical location within the wellhead.

Another illustrative apparatus disclosed herein comprises a tubing hanger with a body and a bore extending through the body, a plurality of orientation slots positioned around an outside perimeter of the body and an orientation key positioned in one of the orientation slots.

BRIEF DESCRIPTION OF THE DRAWINGS

Certain aspects of the presently disclosed subject matter will be described with reference to the accompanying drawings, which are representative and schematic in nature and are not be considered to be limiting in any respect as it relates to the scope of the subject matter disclosed herein.

Figure 1:
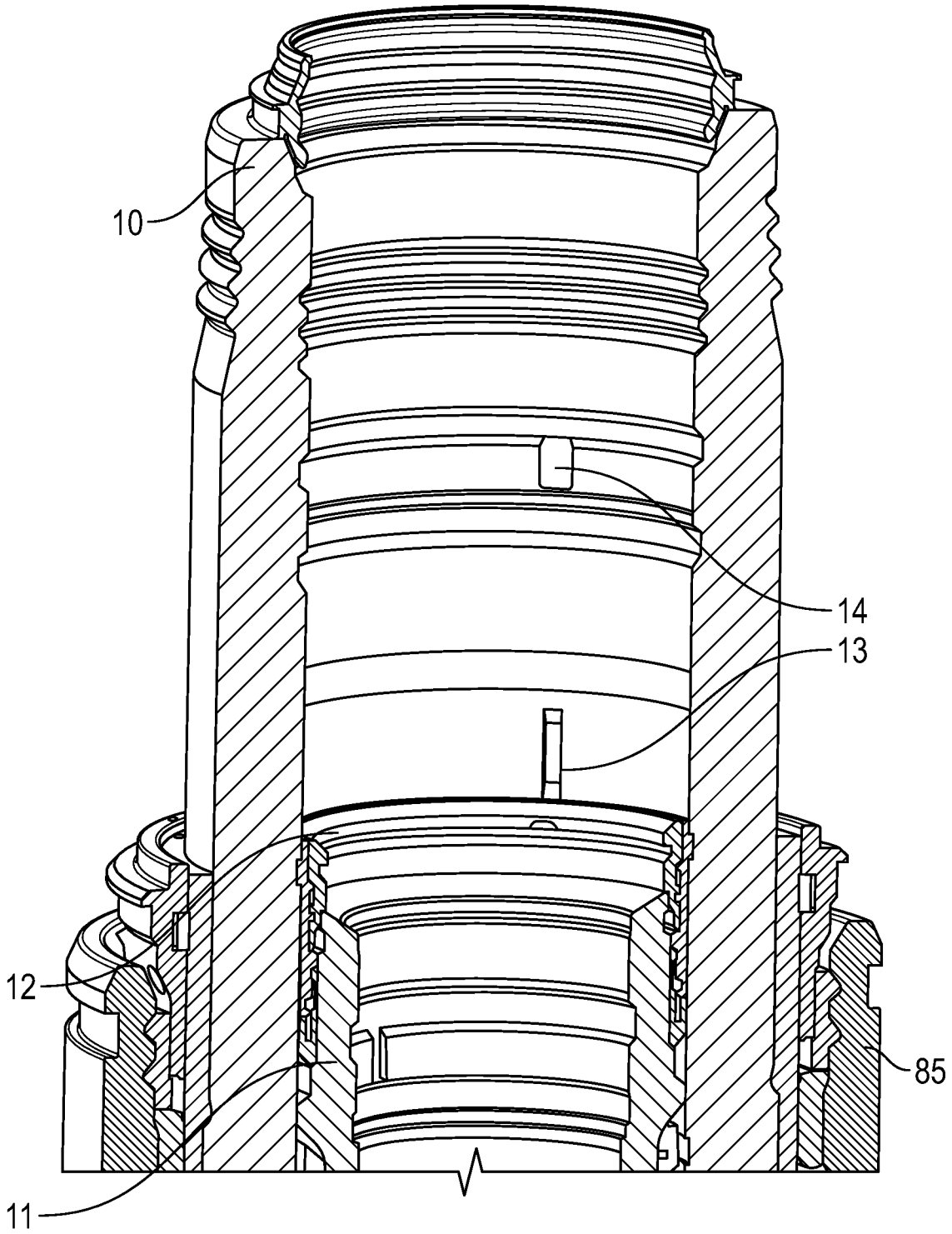
FIGS. 1-9 depict various aspects of one illustrative example of a novel orientation spacer bushing disclosed herein that may be employed to orient a production outlet of a subsea production tree relative to an x-y grid of a subsea production field.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIGS. 1-9 depict various aspects of one illustrative example of a novel passive orientation spacer bushing apparatus 1 disclosed herein that may be employed to orient a component, such as, for example, a tubing hanger, in a wellhead 10 (i.e., high-pressure housing) of an oil and gas well. In the examples depicted herein, the component that engages the spacer bushing apparatus 1 will be an illustrative tubing hanger. However, as will be appreciated by those skilled in the art after a complete reading of the present application, the novel spacer bushing apparatus 1 disclosed herein may be employed when orienting a variety of different components with a well. With reference to FIGS. 1-5, at a very high level, in one illustrative embodiment, the apparatus 1 generally comprises a passive helix structure 20 and an adjustable threaded nut 30 that is adapted to be threadingly coupled to the passive helix structure 20 by a threaded connection, e.g., ACME threads. As described more fully below, after the spacer bushing apparatus 1 is initially positioned or landed in the wellhead 10, the passive helix structure 20 will be prevented from rotating, but it will still be able to be moved vertically within the wellhead 10. To achieve vertical movement of the passive helix structure 20, the adjustable threaded nut 30 will be rotated while the passive helix structure 20 is prevented from rotating which, due to the threaded connection between the two components, will force the passive helix structure 20 to rise vertically within the wellhead 10 to its desired final vertical position within the wellhead 10. After the spacer bushing apparatus 1 is positioned and locked in the wellhead 10 (using a process described more fully below) and oriented with respect to the bushing orientation recess 13 in the wellhead 10, a component, such as a tubing hanger 40 (see FIG. 5) will land on the passive helix structure 20. More specifically, a component orientation key 31 on the component is adapted to initially land on the passive helix structure 20. Once landed, the "weight" of the component (and its associated running string) supported at a surface facility, e.g., a platform or ship, will be reduced, thereby putting more "weight" on the component such that it travels further downward within the well. As the component moves downward, the component will self-rotate (i.e., it will not be rotated using a device such as a top drive) due to the engagement between the component orientation key 31 on the component and the passive helix structure 20. This rotational movement of the tubing hanger 40 will continue until such time as the component orientation key 31 on the component engages with a component orientation recess 21 defined in the passive helix structure 20, thereby orienting the component, e.g., the tubing hanger 40 relative to the passive helix structure 20.

Figure 4:
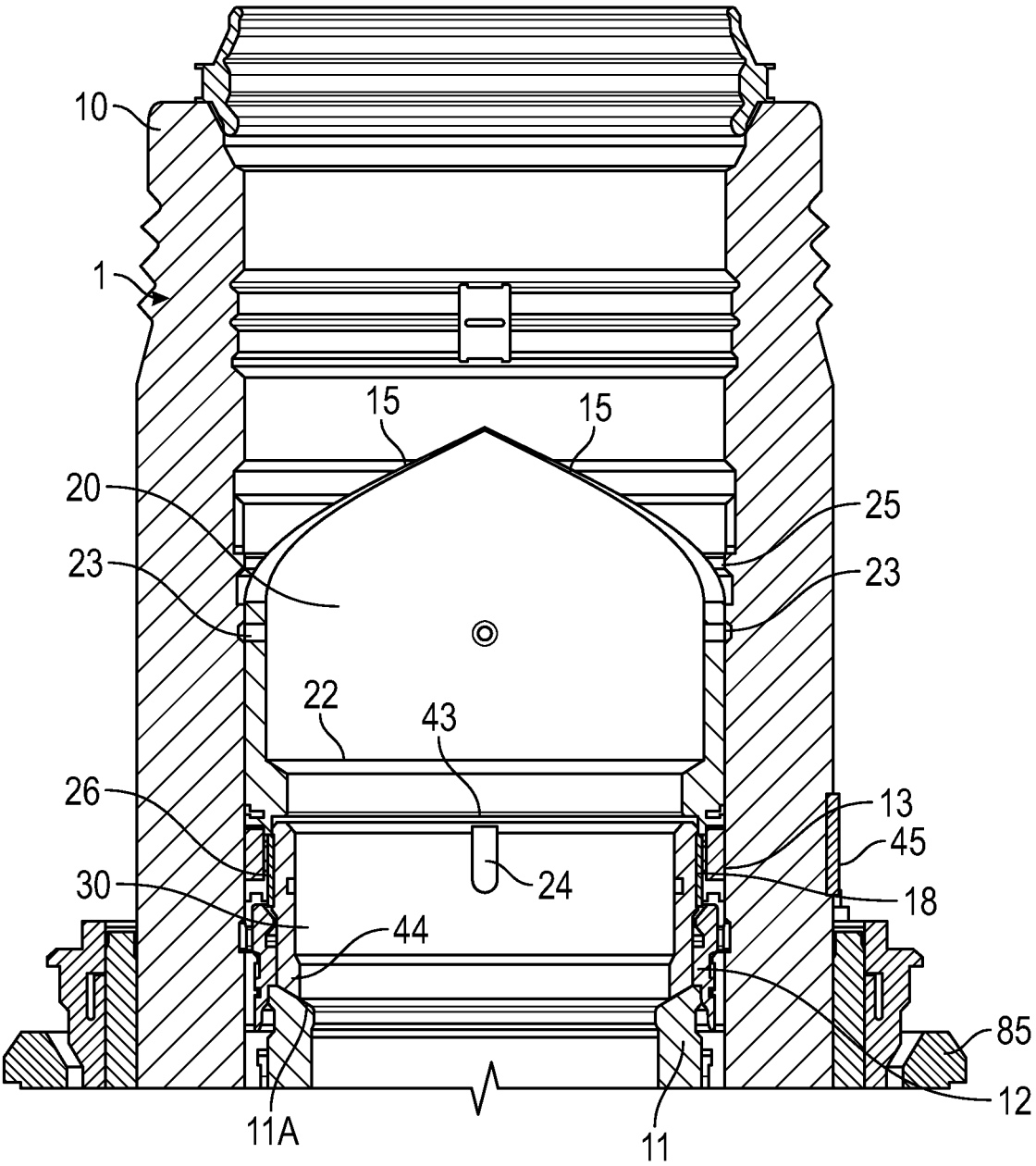

FIG. 1 depicts the wellhead 10 prior to installation of the passive spacer bushing apparatus 1. As shown in FIG. 1, in this example, a casing hanger 11 and an annulus pack-off seal assembly 12 have previously been positioned in the wellhead 10. Also depicted in FIG. 1 is an illustrative conductor pipe 85. As best seen in FIG. 1, the wellhead 10 comprises a spacer bushing orientation recess 13 formed in its inner surface. As shown in FIG. 4, an external indicator or marking 45, such as a painted line or a machined slot, may be formed or placed on the outer surface of the wellhead 10 at a location that corresponds to the location of the spacer bushing orientation recess 13 so that the orientation of the spacer bushing orientation recess 13 may be determined by visual observation (using an ROV) after the wellhead 10 has been installed in the well and prior to installing the tubing hanger 40. Of course, the marking 45 need not be aligned with the spacer bushing orientation recess 13, as the position of the spacer bushing orientation recess 13 relative to any placement of the marking 45 may be readily determined. In other embodiments, the location of the spacer bushing orientation recess 13 may also be determined by external through-wall sensor means (discussed below) that are positioned outside the well or operated by a remotely operated vehicle (ROV). As will be appreciated by those skilled in the art after a complete reading of the present application, by use of the spacer bushing apparatus 1 disclosed herein, the wellhead 10 may be initially installed in the well without regard to the orientation of the wellhead 10 or the spacer bushing orientation recess 13 with respect to any other aspect of the subsea field or an item of subsea equipment. Also depicted in FIG. 1 is another anti-rotation slot 14 for various items of wellhead tooling (not shown).

Figure 2:
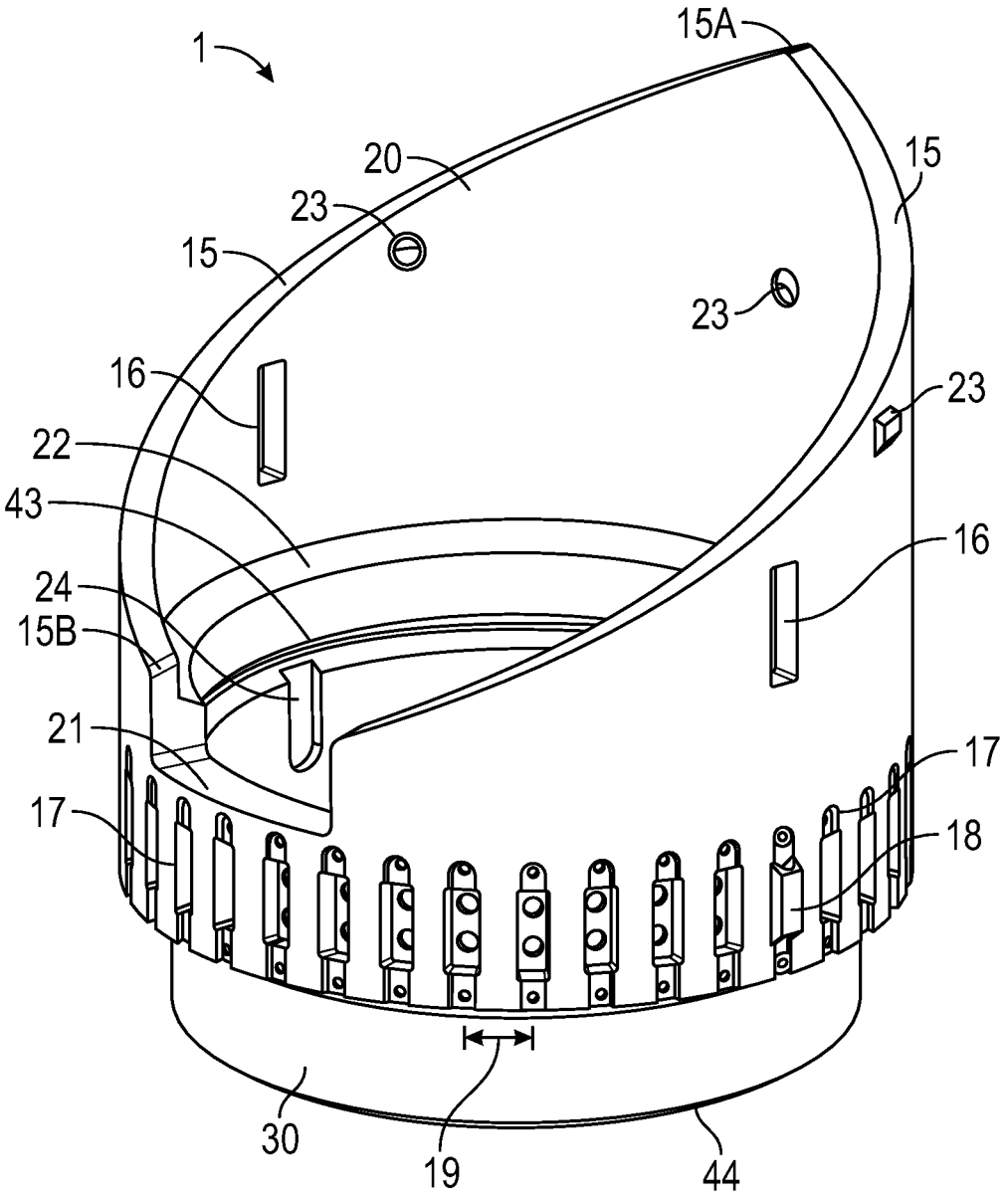
Figure 3:
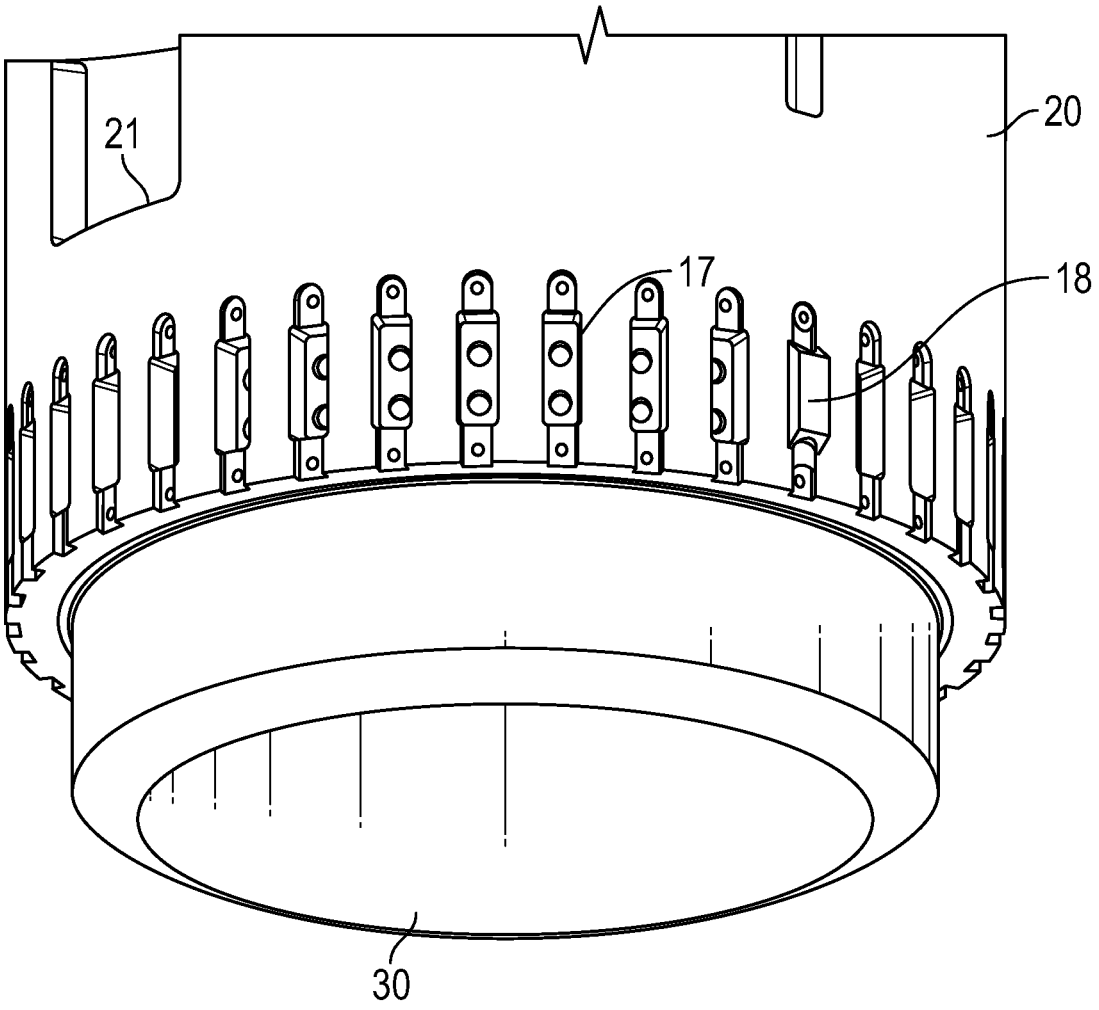

FIGS. 2 and 3 are perspective views that depict one illustrative embodiment of the spacer bushing apparatus 1 outside of the wellhead 10, wherein the spacer bushing apparatus 1 is in its non-expanded state, i.e., wherein the threaded portion of the threaded adjustable nut 30 is fully inserted into a threaded bottom recess 43 in the passive helix structure 20. In one illustrative embodiment, the threaded adjustable nut 30 is externally threaded while the threaded recess 43 is internally threaded. Of course, if desired, the external and internal threading of the nut 30 and the recess 43 may be reversed. FIG. 4 is a cross-sectional view of the spacer bushing apparatus 1 after it has been initially inserted into the wellhead 10, wherein the spacer bushing apparatus 1 is in its non-expanded state. With reference to these drawings, the passive helix structure 20 includes at least one helical surface 15, a plurality of tool slots 16, a plurality of spacer bushing orientation slots 17 that are spaced around the perimeter of the passive helix structure 20, a spring-loaded, outwardly-biased spacer bushing orientation key 18 that is adapted to be positioned in one of the spacer bushing orientation slots 17, a component orientation recess 21, a component landing surface 22 and the above-mentioned threaded recess 43. The passive helix structure 20 also comprises a plurality of spring-loaded, outwardly-biased, height setting keys 23 (three of which are depicted in FIG. 4) that are adapted to engage a recessed groove 25 defined in the wellhead 10. In other cases, the recessed groove may be formed in another structure or component, for example a lock down bushing, that was previously positioned in the wellhead 10, wherein the spacer bushing apparatus 1 will be inserted into the lock down bushing (or any other structure). In the depicted example, the passive helix structure 20 comprises a plurality of helical surfaces 15, the upper ends of which meet at an apex 15A. The component orientation recess 21 is positioned adjacent the bottom ends 15B of the helical surfaces 15.

The spacer bushing orientation key 18 is adapted to engage the spacer bushing orientation recess 13 formed in the inner surface of the wellhead 10. In other cases, the spacer bushing orientation recess 13 may be formed in another structure or component, for example a lock down bushing, that was previously positioned in the wellhead 10, wherein the spacer bushing apparatus 1 will be inserted into the lock down bushing (or any other structure). The engagement between the spacer bushing orientation key 18 and the spacer bushing orientation recess 13 fixes the radial orientation of the passive helix structure 20 relative to the wellhead 10 and prevents further rotational movement of the passive helix structure 20 relative to the wellhead 10 (or other structure in which the spacer bushing apparatus 1 is positioned). The spacer bushing orientation recess 13 has an axial length that is greater than the axial length of the spacer bushing orientation key 18 so as to permit the passive helix structure 20 to move vertically when the spacer bushing orientation key 18 is positioned within the spacer bushing orientation recess 13. FIG. 4 schematically depicts the threaded connection 26 (e.g., ACME threads) between the passive helix structure 20 and the adjustable threaded nut 30. The number of the spacer bushing orientation slots 17 and the amount of the angular spacing 19 between adjacent spacer bushing orientation slots 17 may vary depending upon the particular application. In one illustrative embodiment, the spacer bushing apparatus 1 may comprise thirty five bushing orientation slots 17 that have an equal angular spacing 19 of about ten degrees between the adjacent spacer bushing orientation slots 17. In other embodiments, the bushing orientation slots 17 may not all be equally spaced around the perimeter of the spacer bushing apparatus 1. The angle of the helical surfaces 15 may also vary depending upon the particular application. In one illustrative embodiment, the helical surfaces 15 may be formed at an angle with respect to the horizontal of about 20-30 degrees, and in one particular example, about 26 degrees.

The adjustable threaded nut 30 comprises a plurality of nut tool slots 24 and a bottom landing surface 44. As shown in FIG. 4, the bottom landing surface 44 of the adjustable nut 30 is adapted to land on or engage an upper surface of a component or structure previously positioned in the wellhead 10. In the illustrative example depicted herein, the bottom landing surface 44 is adapted to land on an upper surface 11A on the casing hanger 11 when the spacer bushing apparatus 1, in its non-expanded state, is initially positioned within the wellhead 10. The tool slots 16 in the passive helix structure 20 are provided such that a running tool (described more fully below) may rotate the spacer bushing apparatus 1 (i.e., the combination of the passive helix structure 20 and the adjustable nut 30) after the spacer bushing apparatus 1 has been initially landed in the wellhead 10, as shown in FIG. 4. Note that, in this initially landed position, the height setting keys 23 are positioned below the level of the groove 25 in the wellhead (or other structure) that they will ultimately engage when the passive helix structure 20 is raised to its final height by rotation of the nut 30. As described more fully below, after the spacer bushing apparatus 1 has initially landed in the wellhead 10, the spacer bushing apparatus 1 is rotated until such time as the spacer bushing orientation key 18 engages the spacer bushing orientation recess 13. The nut tool slots 24 in the adjustable nut 30 are provided such that, after the spacer bushing orientation key 18 has engaged the spacer bushing orientation recess 13, the running tool may rotate the adjustable nut 30 relative to the passive helix structure 20 while the passive helix structure 20 is prevented from rotating by the engagement between the spacer bushing orientation key 18 and the spacer bushing orientation recess 13 formed in the inner surface of the wellhead 10 (or other structure). As noted above, the rotation of the adjustable nut 30 relative to the passive helix structure 20 causes the passive helix structure 20 to rise vertically within the wellhead 10 until such time as the spring-loaded, height setting keys 23 engage the groove 25 in the wellhead 10 (or other structure).

Figure 5:
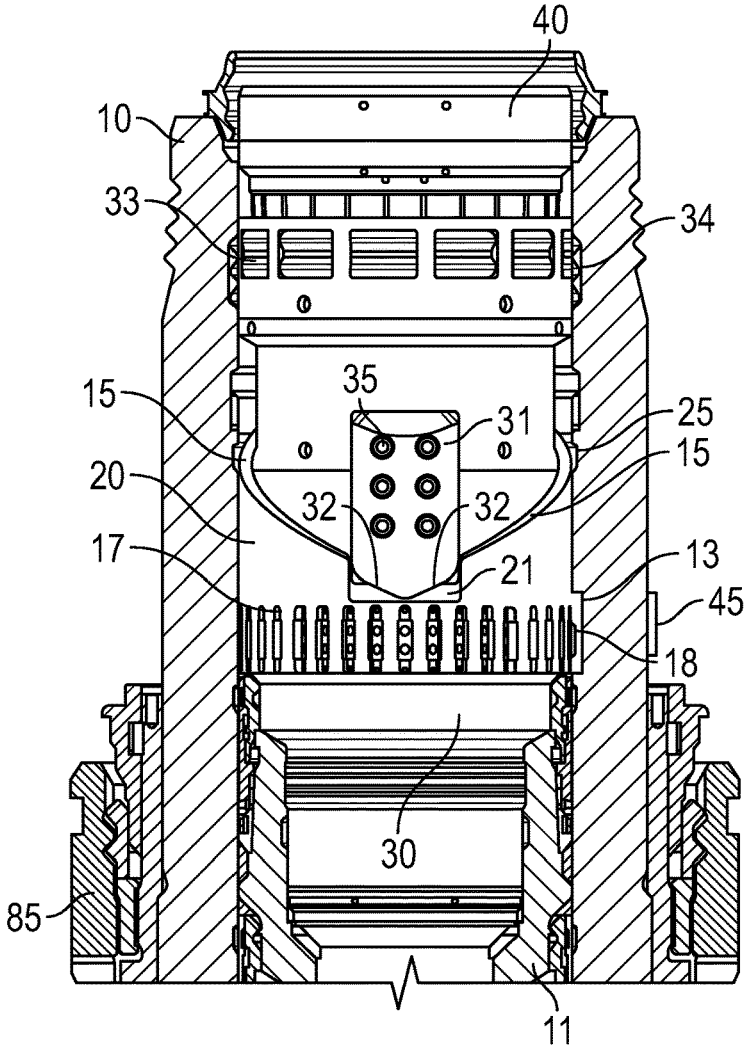

With reference to FIG. 5, as noted above, the tubing hanger 40 comprises a component orientation key 31 that is adapted to engage the component orientation recess 21 in the passive helix structure 20. In the depicted example, the component orientation key 31 is coupled to the component, e.g., the tubing hanger 40, by a plurality of threaded fasteners 35. A plurality of tapered surfaces 32 are provided on the component orientation key 31 so as to permit relatively smooth movement of the component orientation key 31 along the helical surfaces 15 and entry of the component orientation key 31 into the component orientation recess 21. The tubing hanger 40 also comprises a plurality of latching dogs 33 that are adapted to be actuated so as to engage the locking grooves 34 formed in the wellhead 10. A bottom surface (not shown) of the tubing hanger 40 is adapted to engage the component landing surface 22 (see FIG. 4) in the passive helix structure 20.

Figure 6:
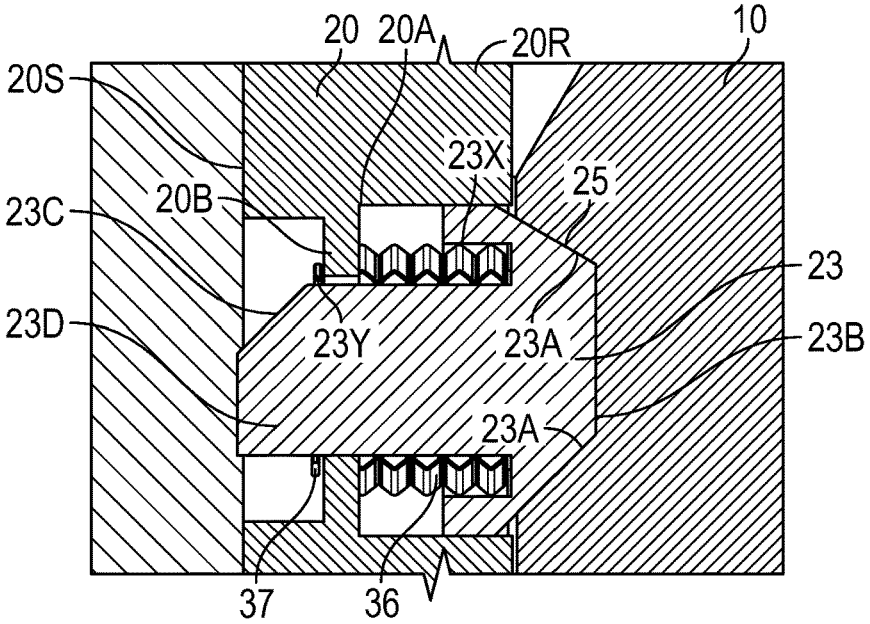

FIG. 6 is an enlarged view of one illustrative embodiment of the spring-loaded, outwardly-biased, height setting keys 23 that may be employed with the illustrative spacer bushing apparatus 1 depicted in FIG. 6. As depicted therein, height setting keys 23 are positioned in a recess 20A defined in the body of the passive helix structure 20. An illustrative spring 3*b*, e.g., a wave spring, is positioned in the recess 20A and in a cavity 23X defined in the back side of the height setting keys 23. The spring 36 is secured to the height setting keys 23 by a clip 37 that is positioned on the inside of a flange 20B in a groove 23Y on the height setting keys 23. The clip 37 generally retains the height setting keys 23 within the recess 20A. FIG. 6 also depicts the inner surface 20S of the passive helix structure 20 and the recessed groove 25 in the wellhead 10, wherein the height setting key 23 is in its fully engaged position (or fully inserted into) with the recessed groove 25. As indicated, in this illustrative embodiment, the height setting keys 23 comprise two front tapered surfaces 23A, a substantially planar front face 23B, a rear tapered surface 23C and a substantially planar rear surface 23D, The running tool that is used to install the spacer bushing apparatus 1 will comprise a plurality of slots or recesses (not shown) that are adapted to receive the rear portion of the height setting key 23, i.e., the portions of the height setting key 23 that project inward beyond the inner surface 20S of the passive helix structure 20 when the running tool is positioned within the interior of the passive helix structure 20. The recesses in the running tool allow the front portion of the height setting key 23 to move inward into the recess 20A in the passive helix structure 20. That is, when the front surface 23B of the height setting key 23 is substantially flush with the outer surface 20R of the passive helix structure 20, a portion of the height setting key 23 moves inwardly of the inner surface 20S. This arrangement allows the height setting keys 23 (which are outwardly biased by the spring 36) to move in and out within the recess 20A as the height setting keys 23 engage the inner surface of the wellhead 10 (or other structure) and/or various grooves formed in the wellhead 10 (or other structure) as the spacer bushing apparatus 1 is moved downwardly in the wellhead 10. When the passive helix structure 20 is raised to its desired final vertical position within the wellhead 10, the spring-loaded, outwardly biased height setting keys 23 will extend and fully engage the recessed groove 25, as shown in FIG. 6. Thereafter, the tubing hanger 40 will be positioned within the passive helix structure 20. A surface of the tubing hanger 40 may engage the rear tapered surface 23C on the height setting keys 23 to the extent that any portion of the height setting keys 23 extend inwardly of the inner surface 20S. Such engagement, if it occurs, will further force the height setting keys 23 into engagement with the recessed groove 25. With the height setting keys 23 in their fully engaged position, the substantially planar rear surface 23D of the height setting keys 23 should be approximately aligned with the inner surface 20S of the passive helix structure 20. An outer surface on the tubing hanger 40 may engage the substantially planar rear surface 23D to thereby insure that the height setting keys 23 remain fully engaged with the recessed groove 25.

One illustrative operational method will now be described to explain how the spacer bushing apparatus 1 disclosed herein may be employed to orient the production outlet (not shown) of a production tree (not shown) that is mounted on the wellhead 10 at any desired angular orientation. In general, a desired target orientation for the production outlet of the production tree to be installed on the wellhead 10 relative to an overall reference system (i.e., an x-y grid) of a subsea production field under development will be set by project requirements. The desired target orientation of the production outlet of the production tree may be based upon a variety of factors such as, for example, the location of manifolds and/or other items of subsea equipment, etc., which will be coupled to the production outlet by some form of a fluid conduit, such as, for example, a flowline (not shown) or a subsea jumper (not shown). Properly orienting the production outlet on the production tree will facilitate efficient use of plot space and permit the desired routing of the subsea flowlines and jumpers, and facilitate accurate fabrication of such subsea jumpers. The tubing hanger 40 typically comprises one or more vertically oriented passages (not shown), e.g., a production passage, an annulus passage, various passages for control lines, etc., that extend through the body of the tubing hanger 40. In the case of a vertical production tree, there are various isolation tubes (not shown) that extend downward from the bottom of the production tree that are adapted to engage the vertically oriented passages defined in the tubing hanger 40 when the production tree is installed on the wellhead 10. Thus, the relative radial orientation between the production tree (and the production outlet of the tree) and the tubing hanger 40 is fixed by virtue of the engagement of these vertically oriented passages and isolation tubes. Thus, orienting the production outlet at the desired target orientation for the production outlet can be accomplished by orienting the tubing hanger 40 at a desired orientation within the wellhead 10.

Initially, the wellhead 10 may be installed in the well without regard to the orientation of the spacer bushing orientation recess 13 in the wellhead 10 (or other structure). Prior to installing the tubing hanger 40, the as-installed orientation or heading of the spacer bushing orientation recess 13 in the wellhead 10 may be determined by locating the outside or external marker 45 (simplistically depicted in FIG. 5) that corresponds to the location of the spacer bushing orientation recess 13 formed on the inner surface of the wellhead 10. The external marker 45 may be located in a variety of different locations depending upon the particular application and, as noted above, the marker 45 may or may not be aligned with the spacer bushing orientation recess 13. In one illustrative embodiment, the external marker 45 may be on the outer surface of the wellhead 10. The location of the external marker 45 may be determined using a variety of techniques such as, for example, using an ROV to visually observe the marking 45 on the outside of the wellhead 10, using a sensor to sense the external marker 45, etc. The as-installed orientation or heading of the spacer bushing orientation recess 13, which corresponds (or may be related) to the as-installed wellhead orientation, may then be recorded relative to the overall reference system for the field under development.

With the as-installed wellhead orientation now known, the spacer bushing orientation key 18 may be positioned in one of the spacer bushing orientation slots 17 in the passive helix structure 20 at the surface on a vessel or platform, i.e., prior to running the spacer bushing apparatus 1 (in its non-extended state) into position in the wellhead 10. The precise spacer bushing slot 17 selected for the spacer bushing orientation key 18 will be selected such that, when the component orientation key 31 is positioned in the component orientation recess 21 defined in the passive helix structure 20, the component, e.g., the tubing hanger 40, will be oriented radially in a desired position such that, when the production tree is coupled to the tubing hanger 40, the production outlet of the production tree will be oriented at the desired target orientation for the production outlet. At that point, with the spacer bushing apparatus 1 at the surface on a vessel or a platform, the adjustable nut 30 may be threaded into the threaded recess 43 in the passive helix structure 20, such that the adjustable nut 30 is positioned as completely as possible within the threaded recess 43 in the passive helix structure 20, i.e., the spacer bushing apparatus 1 is in its non-extended state.

Figure 7:
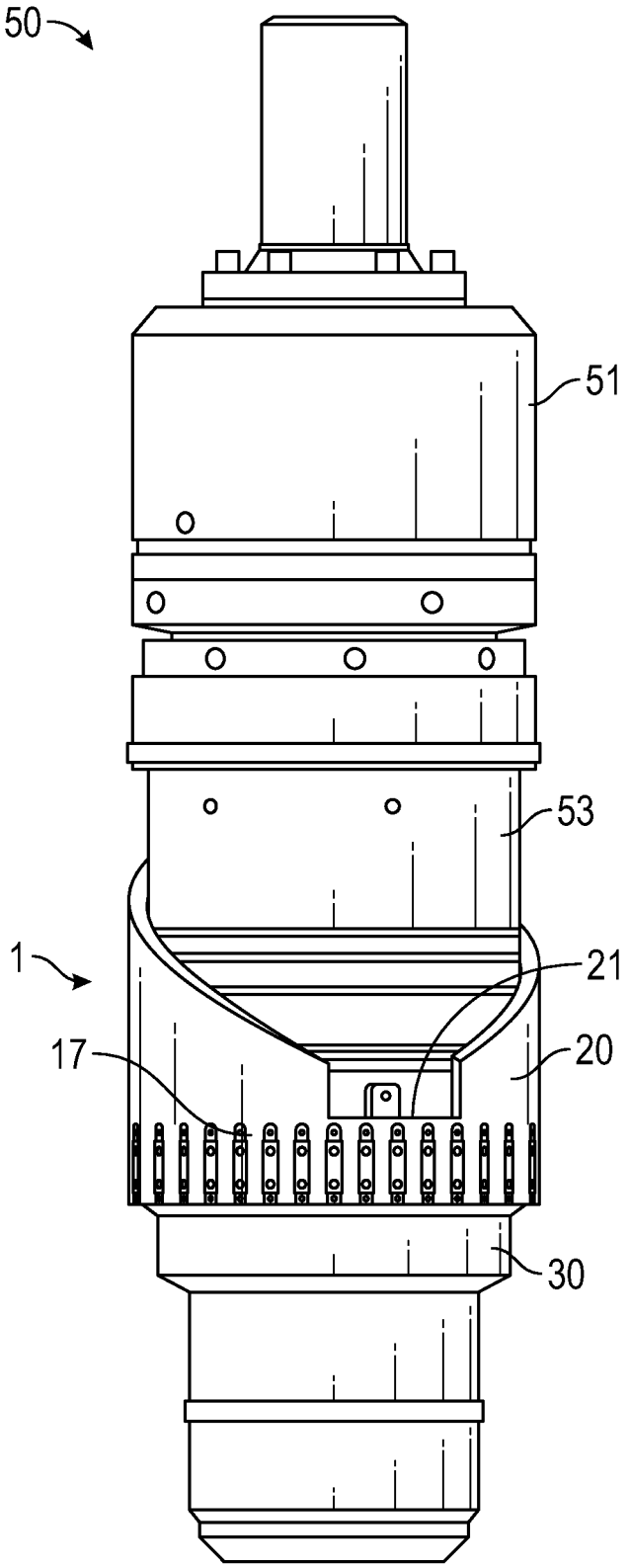
Figure 8:
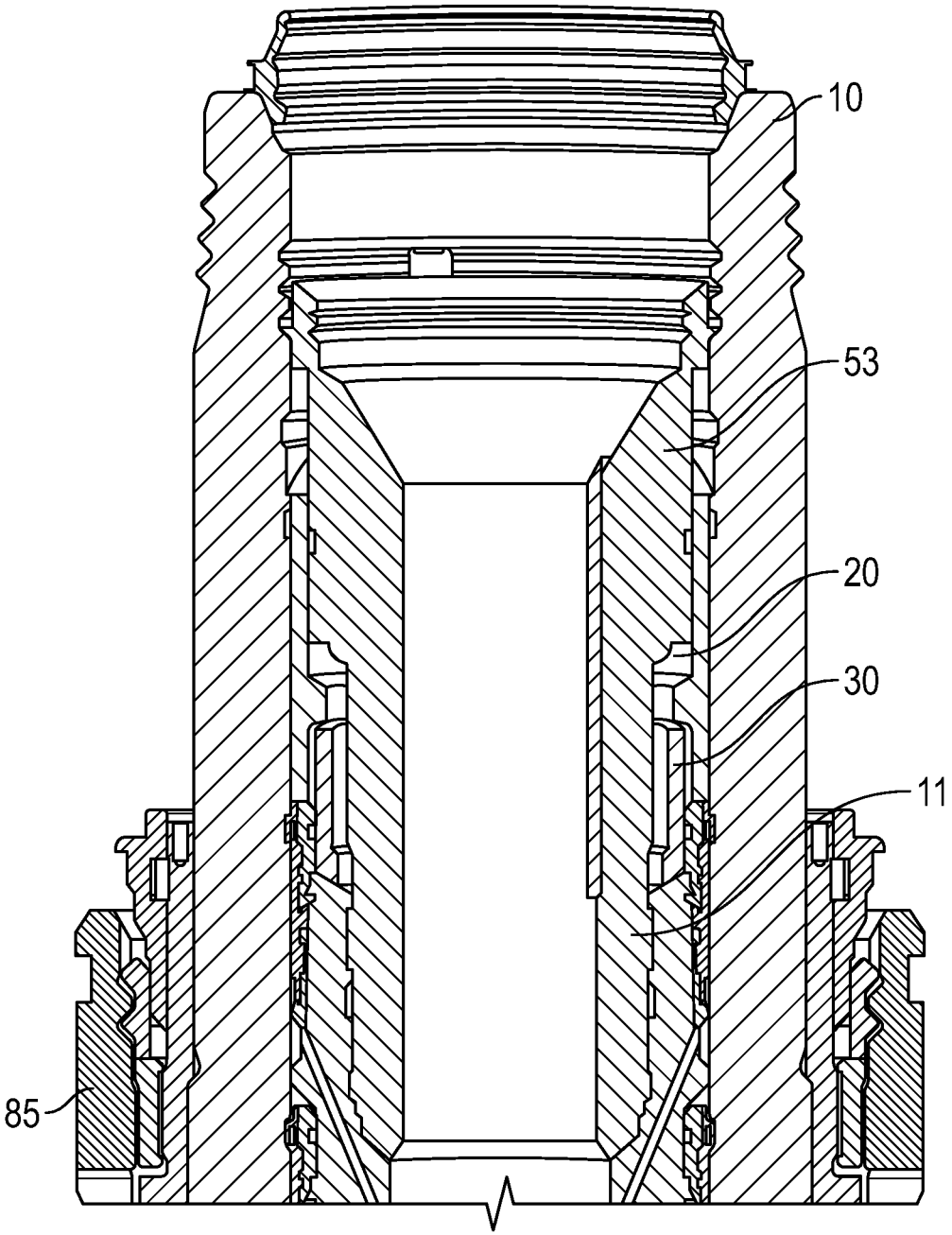

With reference to FIGS. 7 and 8, with the spacer bushing apparatus 1 in its non-extended state, the spacer bushing apparatus 1 may be positioned on a running tool 50. The apparatus 1 will be run into the wellhead through a BOP (not shown) that is operatively coupled to the wellhead 10. In one illustrative embodiment, the running tool 50 generally comprises a spring-loaded tool 51, a torque sub 52 (see FIG. 9) and a wear bushing 53. As depicted, the spacer bushing apparatus 1 (i.e., the passive helix structure 20 and the adjustable nut 30) are positioned around the wear bushing 53. Note that the spacer bushing orientation key 18 is not depicted in FIG. 7. In one embodiment, the passive helix structure 20 may be secured in its position via one or more pinned connections (not shown) between the passive helix structure 20 and the wear bushing 53. In one particular embodiment, a plurality of shear pins may be used to couple the passive helix structure 20 to the wear bushing 53.

Figure 9:
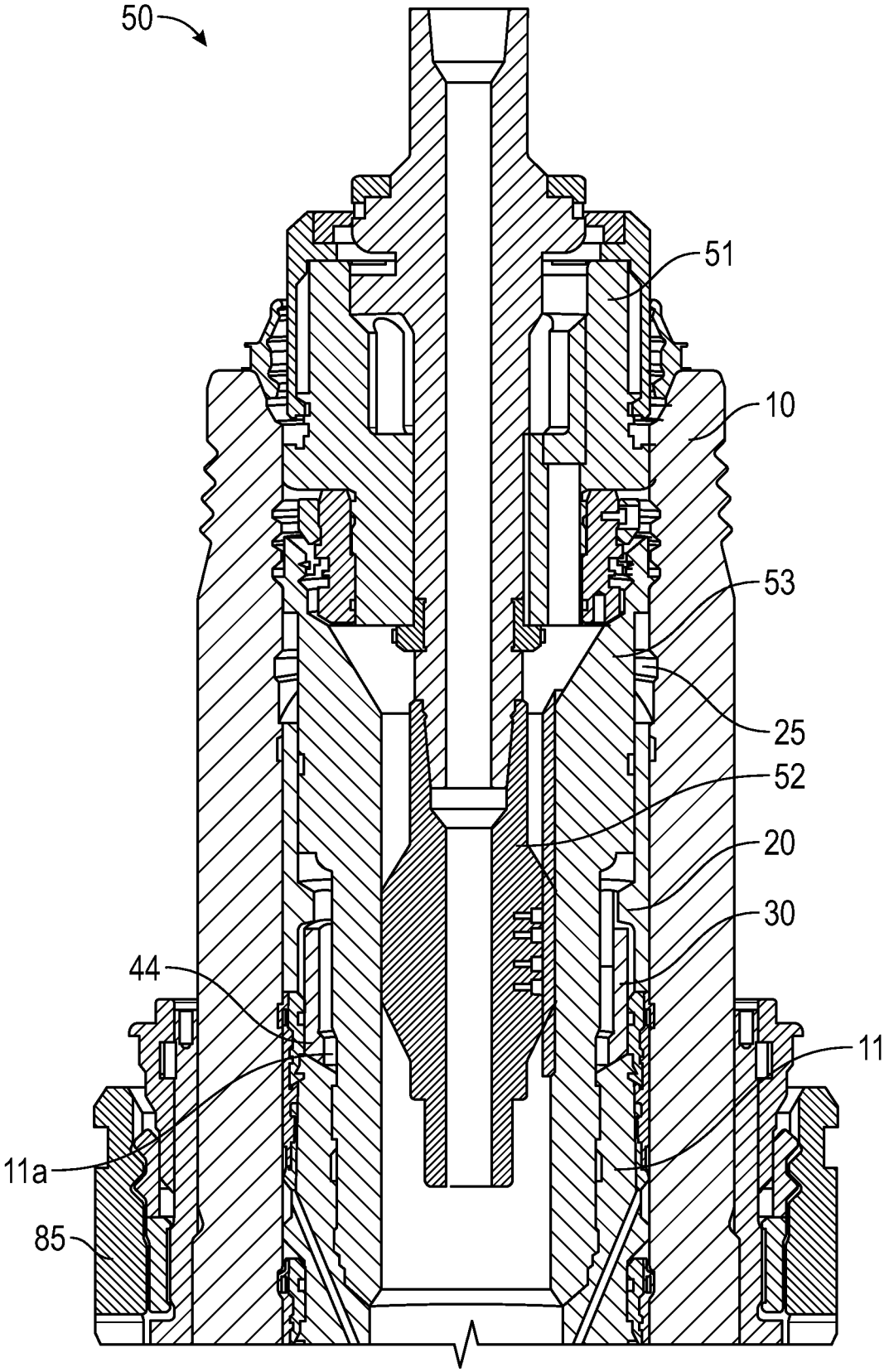

FIG. 9 is a cross-sectional view that depicts spacer bushing apparatus 1 after it has been run into the wellhead 10. At this point the spacer bushing apparatus 1 is still in its non-extended state. Note that the bottom surface 44 of the adjustable nut 30 has landed on and is engaged with the upper surface 11A of the casing hanger 11, i.e., a component that was previously positioned in the wellhead 10. Of course, as will be appreciated by those skilled in the art after a complete reading of the present application, the adjustable nut 30 may land on or engage with any type of structure previously set in the wellhead 10, e.g., a bushing or the like. In this initially landed position, the spring-loaded, outwardly-biased, height setting keys 23 (see, e.g., FIG. 2) are positioned vertically below the recessed groove 25 defined in the wellhead 10 (see FIG. 4). Once the apparatus 1 lands on the casing hanger 11 (or on another structure within the wellhead 10), the tool 51 engages tool slots 16 (see FIG. 2) on the passive helix structure 20 then rotates the entire spacer bushing apparatus 1 until such time as the spring-loaded, outwardly-biased spacer bushing orientation key 18 (on the passive helix structure 20) is aligned with and springs into engagement with the spacer bushing orientation recess 13 in the wellhead 10 (such engagement is not shown in FIG. 9). The engagement between the spacer bushing orientation key 18 and the spacer bushing recess 13 prevents further rotational movement of the passive helix structure 20, while still allowing vertical movement of the passive helix structure 20 within the wellhead 10 due to the greater axial length of the spacer bushing orientation recess 13 as compared to the axial length of the spacer hushing orientation key 18 (as best seen in FIG. 4). At this point, the tool 51 disengages from the tool slots 16 on the passive helix structure 20. The tool 51 then engages the nut tool slots 24 on the adjustable nut 30. Thereafter, the tool 51 is used to rotate the adjustable nut 30 in a clockwise direction (when viewed from above). Since the bottom 44 of the adjustable nut 30 is positioned against the upper surface 11A of the fixed casing hanger 11, rotation of the nut 30 forces the passive helix structure 20 to move vertically upward within the wellhead 10 until such time as the spring-loaded, outwardly-biased, height setting keys 23 are raised to a level where they spring into engagement with the recessed groove 25 defined in the wellhead 10. The spacer bushing apparatus 1 is now in its fully extended and locked position within the wellhead 10. Note that, in using the spacer bushing apparatus 1 disclosed herein, the distance between the landing surface 22 in the passive helix structure 20 and the locking grooves 34 formed in the wellhead 10 is a known value. The tubing hanger 40 can be designed to precisely fit this known distance between the landing surface 22 and the locking grooves 34, thereby insuring that the tubing hanger 40 is installed securely within the wellhead 10.

FIG. 8 depicts the spacer bushing apparatus 1 after the tool 51 has been removed thereby leaving the bushing 53 positioned within the wellhead 10. The production bore (not shown) for the well may then be drilled through the bushing 53. After the production bore has been drilled, the tool 51 may be again run into the wellhead 10 to retrieve the bushing 53, Chile leaving the spacer bushing apparatus 1 in the wellhead 10 in its fully extended and locked position as shown in FIG. 5. At that point, the tubing hanger 40 may be attached a running tool and run into the wellhead 10 whereby one of the tapered surfaces 32 on the component orientation key 31 engages one of the helical surfaces 15 on the passive helix structure 20. At that point, additional "weight" is applied to the tubing hanger, thereby allowing it to travel further within the well and passively self-rotate until such time as the component orientation key 31 engages with the component orientation recess 21 in the passive helix structure 20 and fixes the orientation of the tubing hanger 40 relative to the as-installed orientation of the wellhead 10. At that point, the latching dogs 33 may be actuated so as to engage the locking grooves 34 formed in the wellhead 10, thereby securing the tubing hanger 40 in position within the wellhead 10 (or other structure) at a desired orientation. Thereafter, a production tree may be installed on the wellhead 10 and coupled to the tubing hanger 40.

Figure 10:
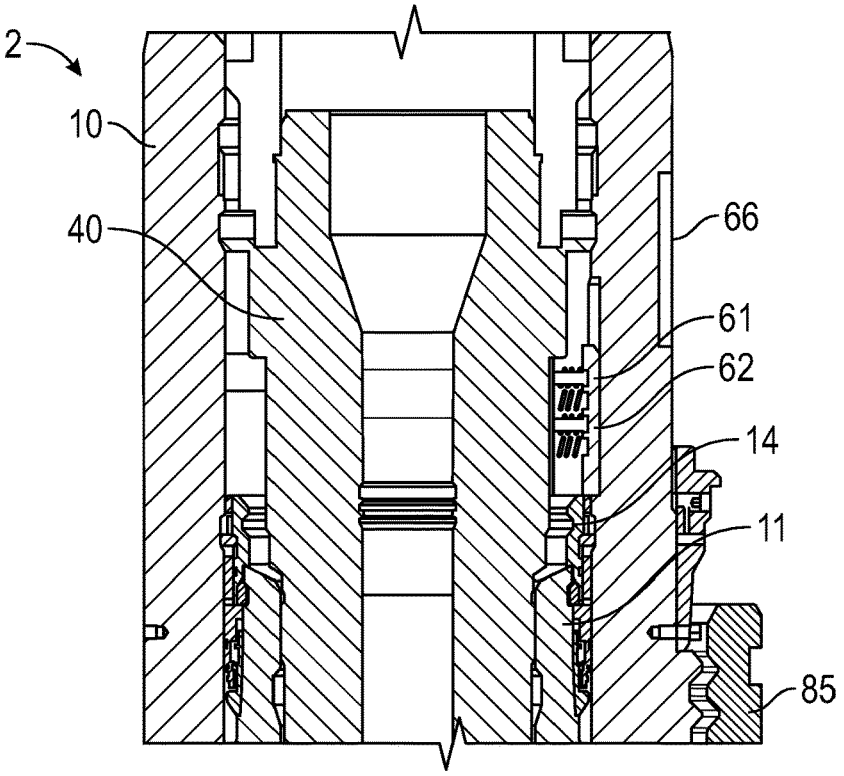
FIGS. 10-15 depict other novel systems, devices and methods for orienting a production outlet of a subsea production tree relative to an x-y grid of a subsea production field.
Figure 11:
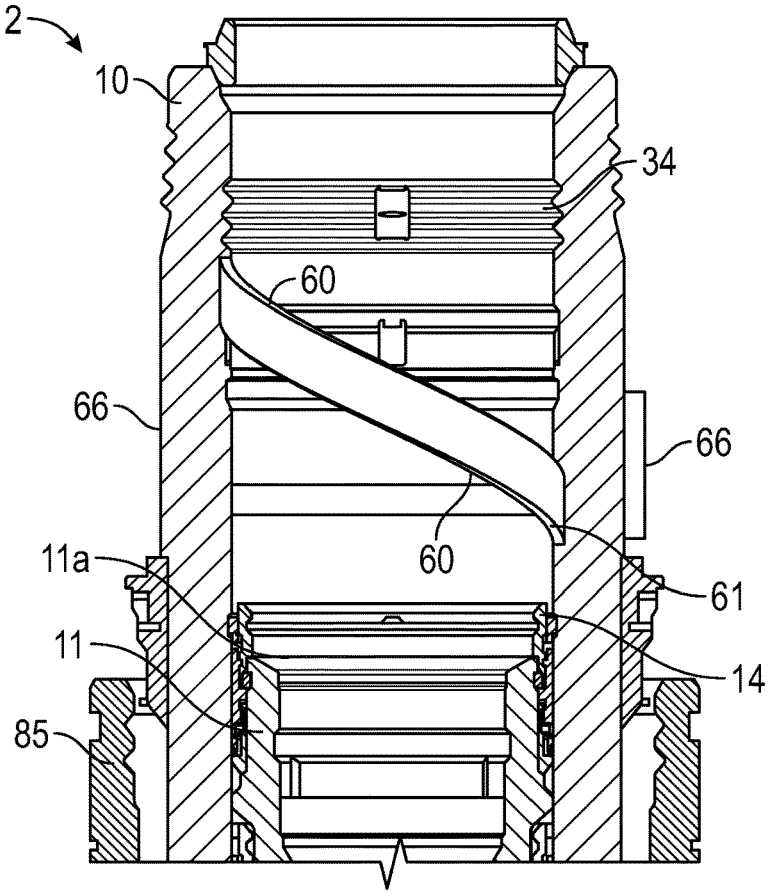
Figure 12:
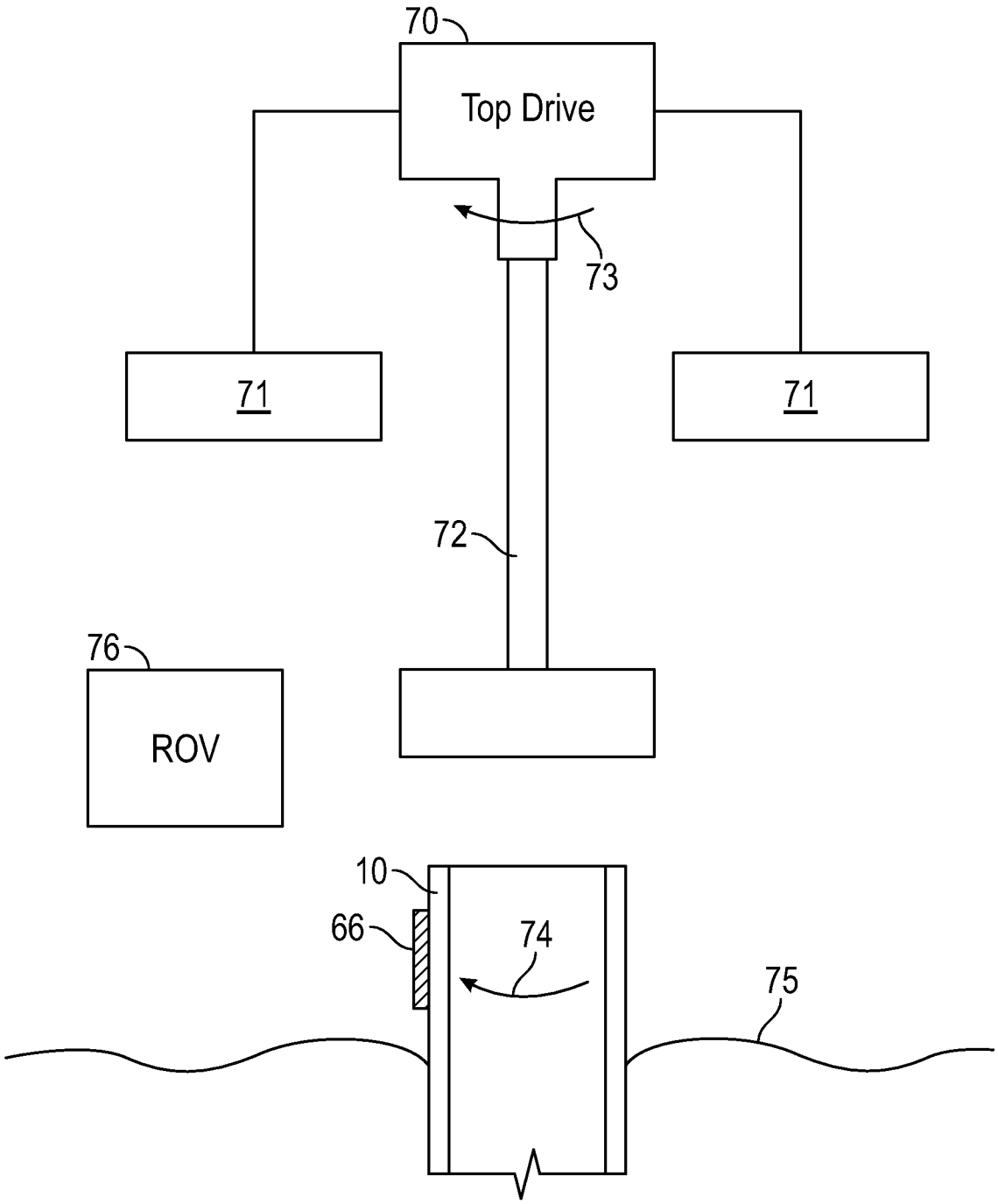

FIGS. 10-12 depict other novel systems, devices and methods for passively orienting a production outlet of a subsea production tree. In this illustrative embodiment, the wellhead 10 will be oriented to the field layout prior to installing the tubing hanger 40 in the wellhead 10. FIG. 11 depicts an apparatus 2 wherein a helical slot or groove 60 has been formed on the inside of the wellhead 10 (or other structure). The groove 60 terminates in a tubing hanger orientation slot 61. With reference to FIG. 11, in this embodiment, the tubing hanger 40 comprises a spring loaded pin 62 that is adapted to engage the helical groove 60 when the tubing hanger 40 is positioned in the wellhead 10. As additional "weight" is applied to the tubing hanger 40, it moves further downward in the wellhead 10. Due to the interaction between the helical groove 60 and the pin 62, the tubing hanger 40 self-rotates until such time as the spring loaded pin 62 is aligned with the tubing hanger orientation slot 61. At that time, the tubing hanger 40 moves further downward until such time as the tubing hanger 40 lands on the casing hanger 11. In this position, the pin 62 is in its final position within the tubing hanger orientation slot 61. At that point, the orientation of the tubing hanger 40 with respect to the orientation of the wellhead 10 is fixed. In one illustrative embodiment, the helical slot or groove 60 may be formed at an angle with respect to the horizontal of about 20-30 degrees, and in one particular example, about 26 degrees.

Prior to installing the wellhead 10, an external reference marker 66 (simplistically depicted in FIG. 10) may be provided on the outside of the wellhead 10 so as to enable proper orientation of the wellhead 10 during the installation process that is discussed more fully below. In one illustrative example, the external reference marker 66 may correspond to the position location of the tubing hanger orientation slot 61 in the wellhead 10. In other embodiments, the reference marker 66 may be placed at any point on the outside of the wellhead 10 as the relative positions of the marker 66 and the tubing hanger orientation slot 61 may be readily determined. After a complete reading of the present application, those skilled in the art will appreciate that the helical groove 60 and the tubing hanger orientation slot 61 could be equally formed in the outer surface of the tubing hanger 40 and the spring loaded pin 62 could be positioned in the inner surface of the wellhead 10. In this latter case, the external reference marker 66 may correspond to the location of the spring loaded pin 62 within the wellhead 10.

With reference to FIGS. 10-12, one illustrative method for passively orienting a production outlet of a subsea production tree using this embodiment will be described. FIG. 12 depicts a simplistic drilling structure 71 (such as a drill ship) that will be used when installing the wellhead 10 (i.e., high-pressure housing) into a conductor pipe 85 that was previously installed in the sea floor 75. The drilling structure 71 includes a traditional top drive 70 that is adapted to rotate a tool or pipe 72, as indicated by the arrow 73, so as to cause rotation of the wellhead 10 (i.e., high-pressure housing), as indicated by the arrow 74, relative to the conductor pipe 85. Also simplistically depicted in FIG. 12 is an ROV 76 that may be used to visually observe the wellhead 10 during the process of orienting the wellhead 10 relative to the field.

Initially, the conductor pipe 85 (not shown in FIG. 12) will be installed in the sea floor 75 without regard to the orientation of the conductor pipe 85. Thereafter, the wellhead 10 will be coupled to the tool 72 and lowered into the proper x-y position above the conductor pipe 85, all while under visual observation via the ROV 76. Once the wellhead 10 is in proper position, and while under visual observation using the ROV 76, the top drive 70 is actuated so as to rotate the wellhead 10 until such time as the external reference marker 66 is at the desired target orientation or heading for the external reference marker 66. At that point, the wellhead 10 is landed and locked within the conductor pipe 85. As a result, the as-installed orientation of the wellhead 10, including the tubing hanger orientation slot 61, is fixed relative to the overall reference system for the field under development, and this as-installed wellhead orientation may then be recorded. Thereafter, a BOP (not shown) may be attached to the wellhead, and various casing hangers and casing strings are installed in the well, e.g., a first casing hanger and a second casing hanger (which, in this embodiment, is the casing hanger 11 reflected in the drawings). Then, the tubing hanger 40 is coupled to a tubing hanger running tool (not shown) and run into the wellhead 10 wherein, in one embodiment, the spring loaded pin 62 on the tubing hanger 40 engages the helical slot or groove 60 defined in the wellhead 10. As noted above, as the tubing hanger 40 moves further downward in the wellhead 10, due to the interaction between the helical groove 60 and the pin 62, the tubing hanger 40 self-rotates until such time as the spring loaded pin 62 is aligned with the tubing hanger orientation slot 61. At that time, the tubing hanger 40 moves further downward until such time as it lands out on the casing hanger 11 and the pin 62 is in position within the tubing hanger orientation slot 61. At that point, the orientation of the tubing hanger 40 is fixed relative to the as-installed orientation of the wellhead 10. Thereafter, the tubing hanger 40 is locked in position. At that point, the tubing hanger running tool can be unlatched from the tubing hanger 40 and retrieved to the surface. Then, the BOP may be retrieved and a production tree may be installed on the wellhead 10 and coupled to the tubing hanger 40 so as to position the production outlet of the production tree at a desired target orientation relative to the field.

Figure 13:
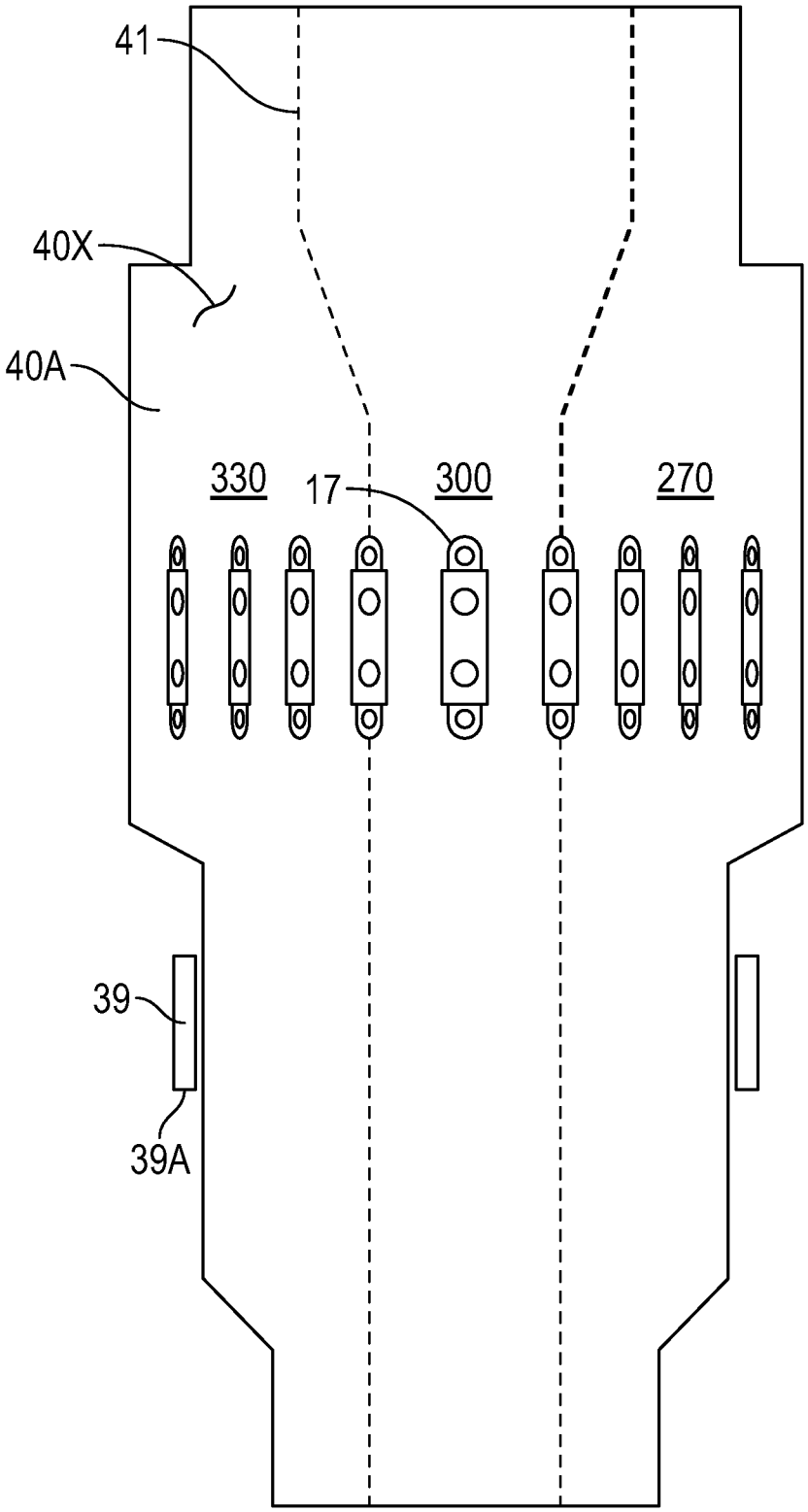

FIG. 13 is a simplistic depiction of another embodiment of a tubing hanger 40A that may be employed in connection with the apparatus shown in FIGS. 10-12. The tubing hanger 40A has a body 40X and an internal passageway or bore 41 as reflected by the dashed lines in FIG. 13. In this example, the above-described orientation slots 17 (see FIGS. 2 and 3—which are now tubing hanger orientation slots) are formed in the body 40X of the tubing hanger 40A around the entire outer perimeter of the tubing hanger 40A. An internally threaded adjustable nut 39 with a bottom landing surface 39A is adapted to be threadingly coupled to the exterior of the body 40X of the tubing hanger 40A prior to the tubing hanger 40A being run into the well, i.e., while the tubing hanger 40A is at a surface location. As before, each of the slots 17 is adapted to receive the above-described orientation spring-loaded, outwardly-biased key 18 (not shown in FIG. 13). The orientation key 18 will be positioned in one of the slots 17 such that, after the tubing hanger 40A is installed, the tubing hanger 40A (and ultimately the production outlet of the production tree) will be properly oriented relative to the field. In this example, the helical slot or groove 60 defined in the wellhead 10 is adapted to receive the orientation key 18 attached to the tubing hanger 40A.

One illustrative method of using the tubing hanger 40A involves the following steps. Initially, the wellhead 10 (i.e., high-pressure housing) may be landed and locked within the conductor pipe 85 without regard to the orientation of the wellhead 10. Thereafter, the as-installed orientation or heading of the wellhead 10 is measured or determined using any of a variety of different techniques. In one example, the as-installed orientation of the wellhead 10 may be determined by observing the orientation of an external reference mark on the wellhead 10. Thereafter, a lead impression tool (not shown) may be run into the well and landed on the uppermost casing hanger. The lead impression tool is used to locate or find the vertical position of the locking grooves (not shown) formed on the inside of the wellhead (or other structure) that will ultimately receive the orientation key 18 when the tubing hanger 40A is positioned at the proper vertical location within the wellhead 10 (or other structure). With the as-installed wellhead orientation now known, the orientation key 18 may be positioned in one of the tubing hanger orientation slots 17 in the tubing hanger 40A while the tubing hanger 40A is at the surface on a vessel or platform, i.e., prior to running the tubing hanger 40A into the well. The precise tubing hanger slot 17 selected for insertion of the orientation key 18 will be determined such that, when the orientation key 18 on the tubing hanger 40A is engaged with the tubing hanger orientation slot 61 in the wellhead 10, the tubing hanger 40A will be oriented radially in a desired position such that, when the production tree is coupled to the tubing hanger 40A, the production outlet of the production tree will be oriented at the desired target orientation for the production outlet. At that point, with the tubing hanger 40A still at the surface, the internally threaded adjustable nut 39 is rotated (clockwise or counter clockwise) so as to fix the vertical distance between the bottom 39A of the adjustable nut 39 and the orientation key 18 such that, when the bottom surface 39A of the adjustable nut 39 lands on the uppermost casing hanger, the orientation key 18 will be positioned vertically within the wellhead such that the orientation key 18 can engage the previously located locking grooves in the wellhead.

Initially, a BOP (not shown) is operatively coupled to the wellhead 10. Thereafter, with the orientation key 18 in the desired tubing hanger slot 17 and the internally threaded adjustable nut 39 in its proper position, the tubing hanger 40A is attached to a tubing hanger running tool and run through the BOP and into the well. As the tubing hanger 40A is advanced down the well, the spring-loaded orientation key 18 will extend into engagement with the helical slot or groove 60. As before, as the tubing hanger 40A is moved further downward in the wellhead 10, due to the interaction between the helical groove 60 and the orientation key 18, the tubing hanger 40A rotates until such time as the orientation key 18 is aligned with the tubing hanger orientation slot 61. At that time, the tubing hanger 40A moves further downward until such time as it lands out on the casing hanger 11 and the orientation key 18 is in position within the tubing hanger orientation slot 61. At that point, the orientation of the tubing hanger 40A is fixed relative to the as-installed orientation of the wellhead 10. Thereafter, the tubing hanger 40A is locked in position. At that point, the tubing hanger running tool can be unlatched from the tubing hanger 40A and retrieved to the surface. Then, the BOP may be retrieved and a production tree may be installed on the wellhead 10 and coupled to the tubing hanger 40A so as to position the production outlet of the production tree at a desired target orientation relative to the field.

Figure 14:
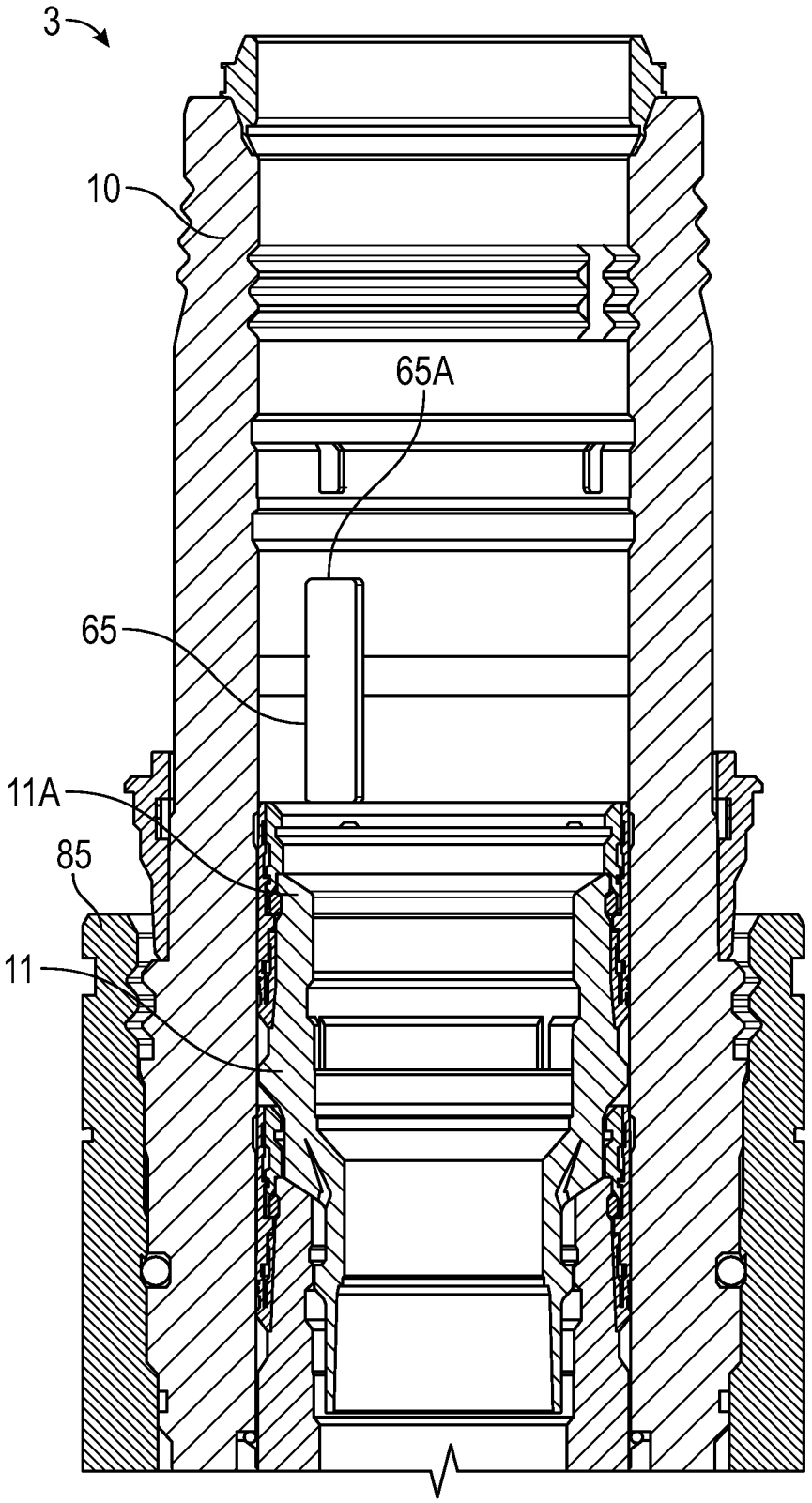
Figure 15:
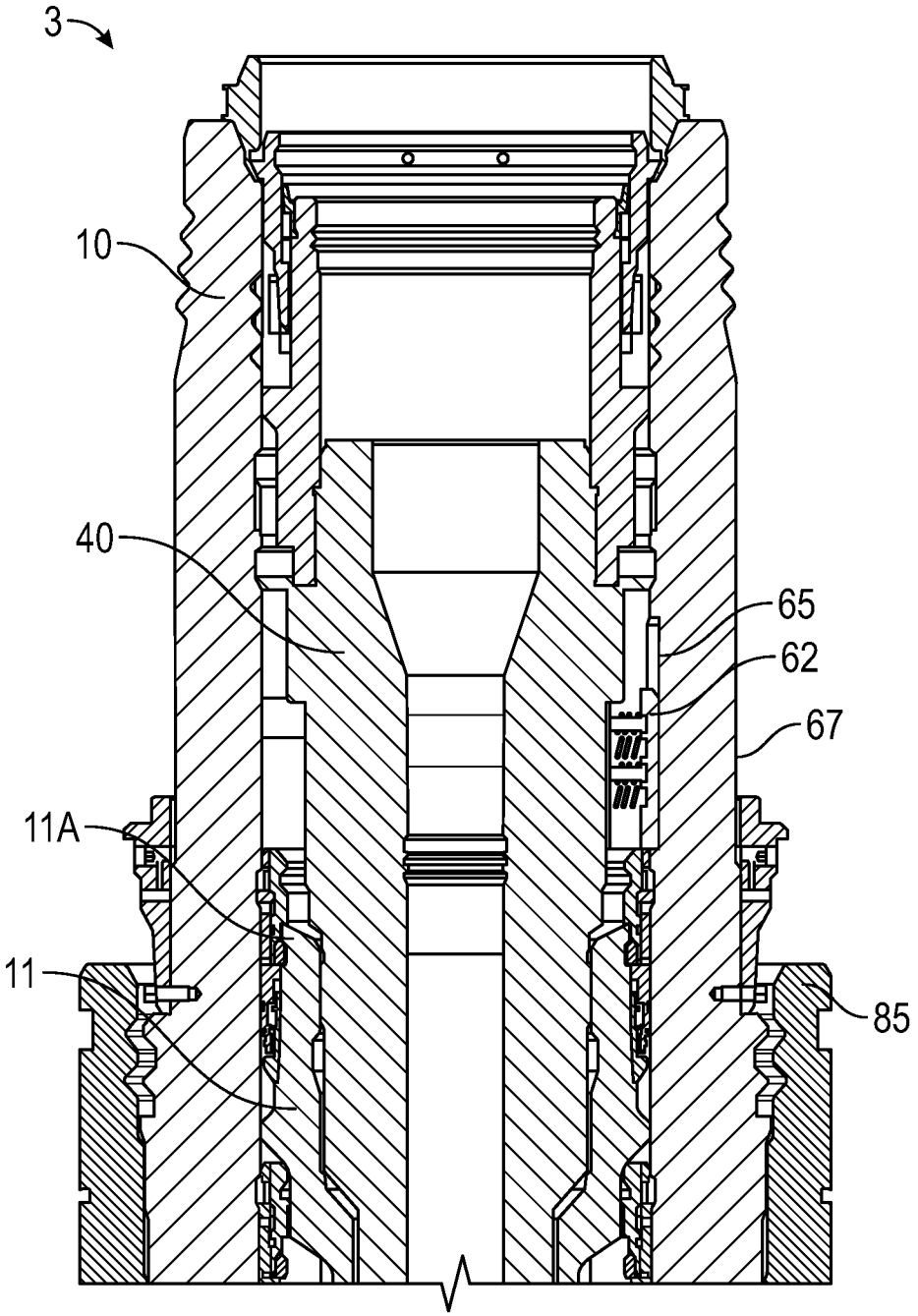

FIGS. 14-15 depict other novel systems, devices and methods for actively orienting a production outlet of a subsea production tree. In this illustrative embodiment, the wellhead 10 will also be oriented to the field layout prior to installation of the tubing hanger 40 in the wellhead 10. FIG. 14 depicts an apparatus 3 wherein a groove 65 has been formed on the inside of the wellhead 10. In one illustrative embodiment, the groove 65 may be formed such that its long axis is substantially normal or perpendicular to the horizontal. In the depicted example, the upper end 65A of the groove 65 is closed. With reference to FIG. 15, in this embodiment, the tubing hanger 40 comprises a spring loaded pin 62 that is adapted to engage the vertically oriented groove 65 when the tubing hanger 40 is positioned in the wellhead 10. As the tubing hanger 40 is positioned within the wellhead 10, the tubing hanger 40 lands on the casing hanger 11. At that point, the tubing hanger running tool is actuated so as to actively rotate the tubing hanger 40 until such time as the spring loaded pin 62 is aligned with and springs into engagement with the vertically oriented groove 65. In this position, the orientation of the tubing hanger 40 is fixed with respect to the orientation of the wellhead 10. Prior to installing the wellhead 10, an external reference marker 67 (simplistically depicted in FIG. 15) may be provided on the outside of the wellhead 10 so as to enable proper orientation of the wellhead 10 during the installation process that is discussed more fully below. In one illustrative example, the external reference marker 67 may correspond to the location of the groove 65 in the wellhead 10. In other embodiments, the reference marker 67 may be placed at any point on the outside of the wellhead 10 as the relative positions of the marker 67 and the groove 65 may be readily determined. After a complete reading of the present application, those skilled in the art will appreciate that the groove 65 could be equally formed in the outer surface of the tubing hanger 40 and the spring loaded pin 62 could be positioned in the inner surface of the wellhead 10. In this latter case, the external reference marker 67 may correspond to the location of the spring loaded pin 62 within the wellhead 10.

With reference to FIGS. 12 and 14-15, one illustrative method for actively orienting a production outlet of a subsea production tree using this embodiment will be described. Initially, the conductor pipe 85 will be installed in the sea floor 75 without regard to the orientation of the conductor pipe 85. Thereafter, the wellhead 10 will be coupled to the tool 72 and lowered into the proper x-y position above the conductor pipe 85, all while under visual observation via the ROV 76. Once the wellhead 10 is in proper position, and while under visual observation using the ROV 76, the top drive 70 is actuated so as to rotate the wellhead 10 until such time as the external reference marker 67 is at the desired target orientation or heading for the external reference marker 67. Thereafter, the wellhead 10 is landed and locked within the conductor pipe 85. At that point, the as-installed orientation of the wellhead 10, including the groove 65, is fixed relative to the overall reference system for the field under development, and this as-installed wellhead orientation may then be recorded. Thereafter, a BOP (not shown) may be attached to the wellhead, and various casing hangers and casing strings are installed in the well, e.g., a first casing hanger and a second casing hanger (which, in this embodiment, is the casing hanger 11 reflected in the drawings). Next, the tubing hanger 40 is coupled to a tubing hanger running tool (not shown) and run into the wellhead 10 until the tubing hanger 40 lands on the casing hanger 11. At that point, the tubing hanger running tool is actuated so as to actively rotate the tubing hanger 40 until such time as the spring loaded pin 62 in the tubing hanger 40 is aligned with and springs into engagement with the groove 65, thereby preventing further rotation of the tubing hanger 40. In this position, the orientation of the tubing hanger 40 is fixed with respect to the as-installed orientation of the wellhead 10. Thereafter, the tubing hanger 40 is locked in position. At that point, the tubing hanger running tool can be unlatched from the tubing hanger 40 and retrieved to the surface. Then, the BOP may be retrieved and a production tree may be installed on the wellhead 10 and coupled to the tubing hanger 40 so as to position the production outlet of the tree at a desired target orientation relative to the field.

In another embodiment, the tubing hanger 40A (depicted in FIG. 13) may be employed with equipment shown in FIGS. 14-15, As noted above, the tubing hanger 40A comprises a plurality of the above-described orientation slots 17 (which are now tubing hanger orientation slots) that are formed in the body of the tubing hanger 40A around the entire outer perimeter of the tubing hanger 40A. As before, each of the slots 17 is adapted to receive the above-described orientation key 18. In this example, the above-described groove 65 is formed in the wellhead 10.

One illustrative method of using the tubing hanger 40A with the groove 65 formed in the wellhead 10 involves the following steps. Initially, the wellhead 10 (i.e., high-pressure housing) may be landed and locked within the conductor pipe 85 without regard to the orientation of the wellhead 10. Thereafter, the as-installed orientation or heading of the wellhead 10 is measured or determined using any of a variety of different techniques. With the as-installed orientation of the wellhead now known, the orientation key 18 may be positioned in one of the tubing hanger orientation slots 17 in the tubing hanger 40A while the tubing hanger 40A is at the surface on a vessel or platform, i.e., prior to running the tubing hanger 40A into the well. As before, the precise tubing hanger orientation slot 17 selected for insertion of the orientation key 18 will be determined such that, when the orientation key 18 on the tubing hanger 40A is engaged with the slot 65 in the wellhead 10, the tubing hanger 40A will be oriented radially in a desired position such that, when the production tree is coupled to the tubing hanger 40A, the production outlet of the production tree will be oriented at the desired target orientation for the production outlet.

As before, the tubing hanger 40A will be run into the well through a BOP (not shown) that is operatively coupled to the wellhead 10. The tubing hanger 40A initially lands on an upper surface of a structure previously positioned in the well, e.g., the upper surface 11A of the casing hanger 11 shown in FIG. 14. Once the tubing hanger 40A lands on the casing hanger 11 (or on another structure within the wellhead 10), the tubing hanger running tool (or other means) may be employed so as to actively rotate the tubing hanger 40A until such time as the spring-loaded, outwardly-biased orientation key 18 (on the tubing hanger 40A) is aligned with and springs into engagement with the groove 65 in the wellhead 10. The engagement between the tubing hanger orientation key 18 and the groove 65 prevents further rotational movement of the tubing hanger 40A and fixes the orientation of the tubing hanger 40A relative to the known orientation of the wellhead 10. In some embodiments, the axial length of the tubing hanger orientation key 18 and the groove 65 in the wellhead may be approximately the same so as to effectively set the vertical position of the tubing hanger 40A within the well. In other cases, the groove 65 may be open at its top or it may have an axial length greater than that of the orientation key 18.

Figure 16:
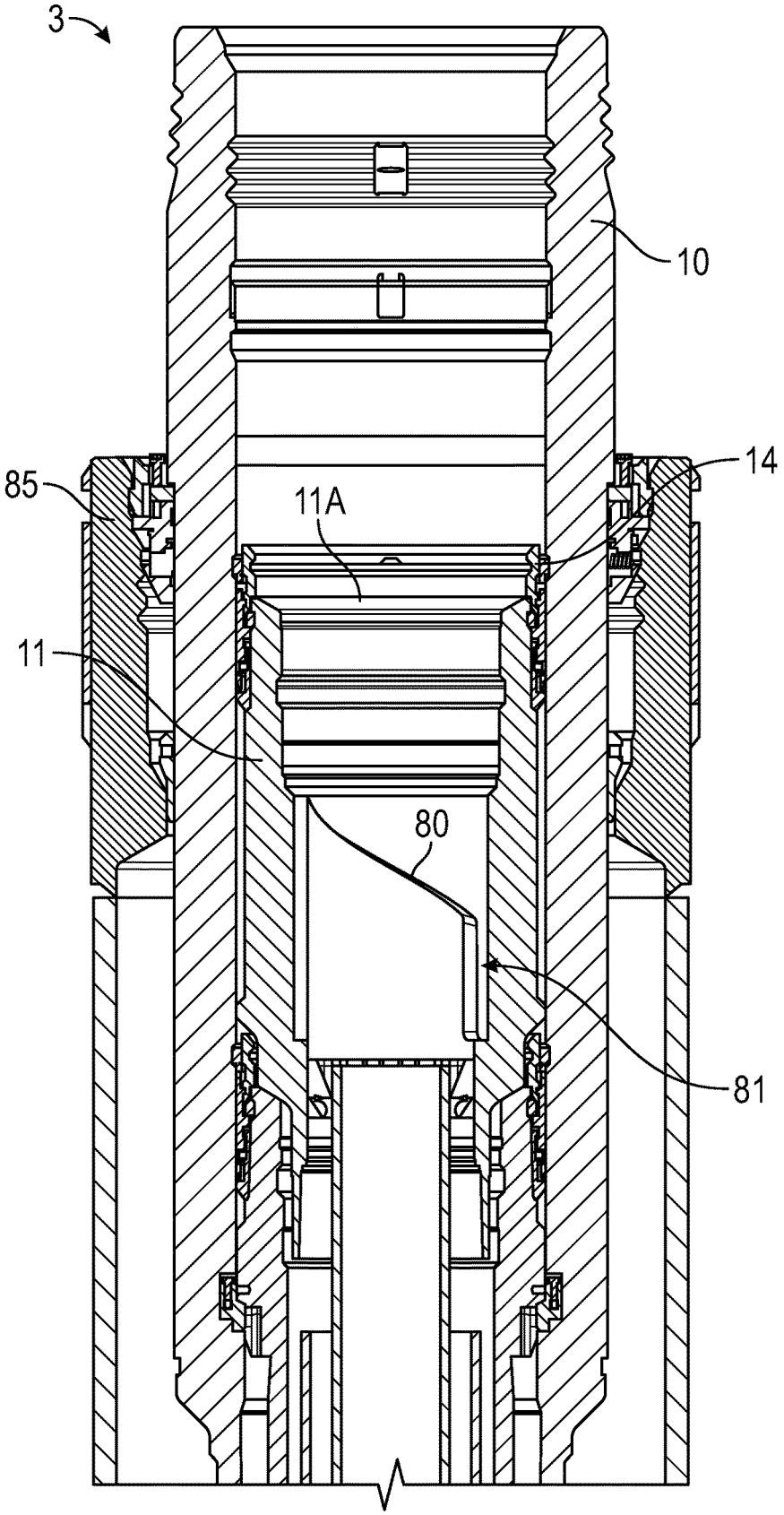
FIGS. 16-19 depict yet other novel systems, devices and methods for orienting a production outlet of a subsea production tree relative to an x-y grid of a subsea production field.
Figure 17:
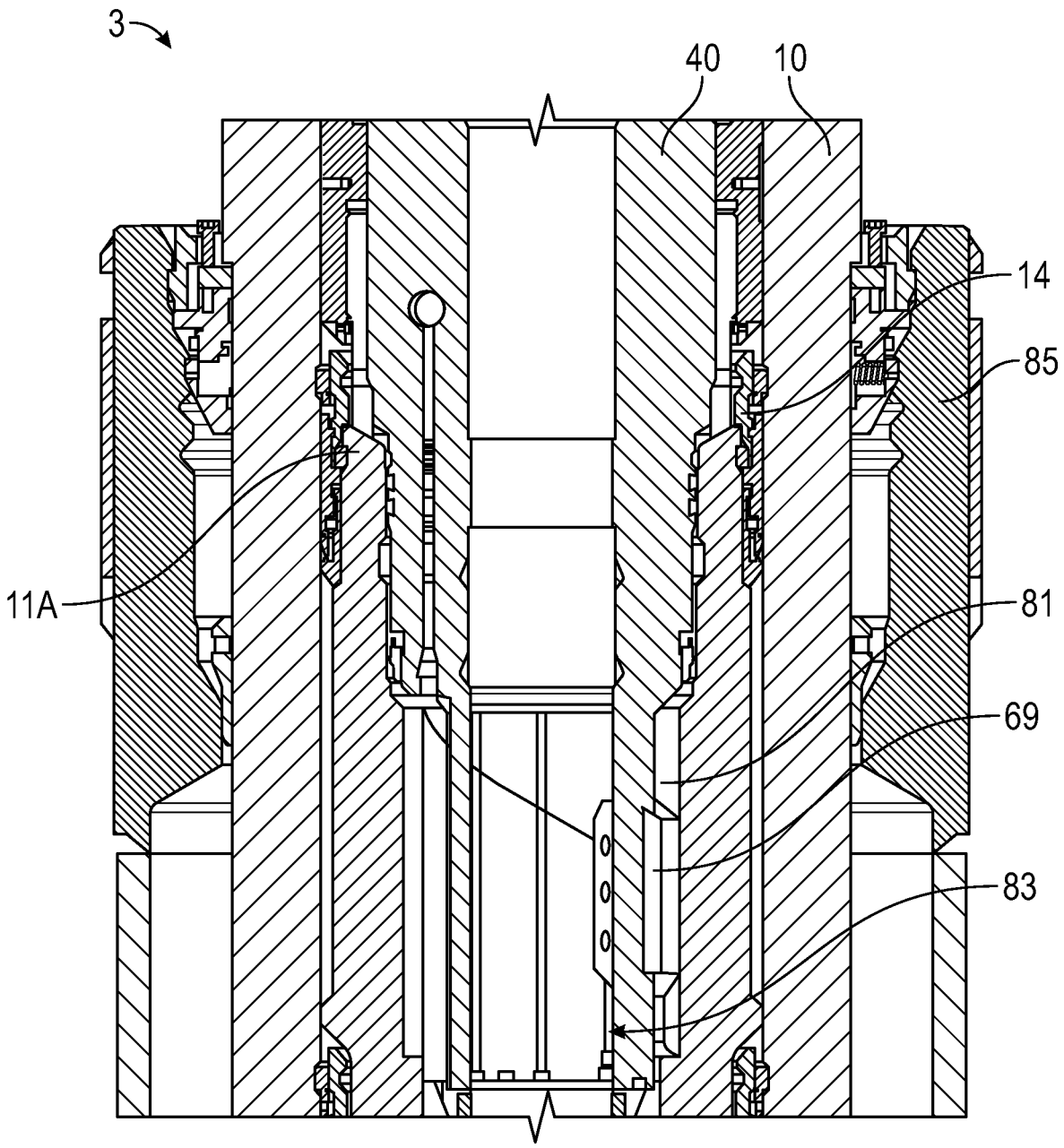

FIGS. 16-17 depict yet other novel systems, devices and methods for passively orienting a production outlet of a subsea production tree. In this illustrative embodiment, the wellhead 10 will not be oriented to the field layout prior to installation of the tubing hanger in the wellhead 10. FIG. 16 depicts an apparatus 3 wherein a helical slot or groove 80 has been formed on the inside of the uppermost casing hanger 11 within the wellhead 10. The groove 80 terminates in a tubing hanger orientation slot 81. Also depicted in FIG. 16 is a schematically depicted external sensor system 83 (described more fully below) that is adapted to sense the location and orientation of the orientation slot 81 after the casing hanger 11 has been positioned and locked within the wellhead 10. The external sensor system 83 is adapted to sense the location of the orientation slot 81 through the wall of the wellhead 10 and the illustrative conductor pipe 85 as well as any other materials or structures positioned between the sensor system 83 and the orientation slot 81. In one illustrative embodiment, the sensor system 83 may extend around the entire perimeter of the wellhead 10, or it may be positioned only around portions of the perimeter of the wellhead 10. The sensor system 83 may take the form of a substantially continuous ring comprised of a plurality of sensors or a plurality of partial ring segments positioned around the outside of the wellhead 10 or the conductor pipe 85 (i.e., the arrangement depicted in FIG. 16). In yet another embodiment, the sensor system 83 may not be physically attached to any of the structures that comprise the overall well. Rather, in one illustrative embodiment, the sensor system 83 may be a physically separate system that is adapted to be moved around the outside of the overall wellhead structure by an ROV so as to locate the orientation slot 81 within the casing hanger 11. Once the as-installed orientation or heading of the orientation slot 81 is determined using the sensor system 83, the sensor system 83 may be retrieved to the surface using the ROV.

With reference to FIG. 17, in this embodiment, the tubing hanger 40 comprises a fixed key 69 that is adapted to engage the helical groove 80 when the tubing hanger is positioned in the wellhead 10 and lands in the casing hanger 11. As more "weight" is applied to the tubing hanger 40, it moves further downward within the casing hanger 11. Due to the interaction between the helical groove 80 and the fixed key 69, the tubing hanger 40 self-rotates until such time as the fixed key 69 is aligned with the tubing hanger orientation slot 81. At that time, the tubing hanger 40 moves further downward until such time as the tubing hanger 40 lands on the surface 11A of the casing hanger 11. In this position, the fixed key 69 is in its final position within the tubing hanger orientation slot 81. At that point, the orientation of the tubing hanger 40 is fixed with respect to the as-installed orientation of the casing hanger 11. In one illustrative embodiment, the helical slot or groove 80 may be formed at an angle with respect to the horizontal of about 20-45 degrees, and in one particular example, about 26 degrees. After a complete reading of the present application, those skilled in the art will appreciate that the helical groove 80 and the tubing hanger orientation slot 81 could be equally formed in the outer surface of the tubing hanger 40 and the fixed key 69 could be positioned in the inner surface of the casing hanger 11.

With reference to FIGS. 12 and 16-17, one illustrative method for passively orienting a production outlet of a subsea production tree using this embodiment will be described. In this embodiment, the conductor pipe 85 and the wellhead 10 are installed in the sea floor 75 without regard to the orientation of either the conductor pipe 85 or the wellhead 10. Thereafter, a BOP (not shown) is installed on the wellhead 10. Then, a first casing hanger (not shown) is installed in the wellhead without regard to its orientation. Thereafter, the second or uppermost casing hanger 11 is positioned within the wellhead 10. The top drive 70 is then actuated so as to rotate the casing hanger 11 until such time as the sensor system 83 determines that the orientation slot 81 in the casing hanger 11 is at the desired target orientation or heading. At that point, the casing hanger 11 is locked into position within the wellhead 10 so as to set the as-installed orientation of the casing hanger 11, including the tubing hanger orientation slot 81, relative to the overall reference system for the field under development. The as-installed orientation of the casing hanger 11 may then be recorded. Thereafter, the tubing hanger 40 is coupled to a tubing hanger running tool (not shown) and run into the wellhead 10 wherein, in one embodiment, the fixed key 69 on the tubing hanger 40 engages the helical slot or groove 80 defined in the casing hanger 11. As noted above, as the tubing hanger 40 moves further downward in the casing hanger 11, due to the interaction between the helical groove 80 and the fixed key 69, the tubing hanger 40 self-rotates until such time as the fixed key 69 is aligned with the tubing hanger orientation slot 81. At that time, the tubing hanger 40 moves further downward until such time as it lands out on the casing hanger 11 and the fixed key 69 is in its final position within the tubing hanger orientation slot 61. At that point, the orientation of the tubing hanger 40 is fixed relative to the as-in-stalled orientation of the casing hanger 11. Thereafter, the tubing hanger 40 is locked in position. At that point, the tubing hanger running tool can be unlatched from the tubing hanger 40 and retrieved to the surface. Then, the BOP may be retrieved and a production tree may be installed on the wellhead 10 and coupled to the tubing hanger 40 so as to position the production outlet of the production tree at a desired target orientation relative to the field.

In another embodiment, a tubing hanger 40A (similar to the one depicted in FIG. 13) may be employed with equipment shown in FIGS. 16-17. As noted above, the tubing hanger 40A comprises a plurality of the above-described orientation slots 17 (which are now tubing hanger orientation slots) that are formed in the body of the tubing hanger 40A around the entire outer perimeter of the tubing hanger 40A. In this example, each of the slots 17 is adapted to receive a fixed key 69 (not shown in FIG. 13). In this example, the above-described helical slot or groove 80 has been formed on the inside of the uppermost casing hanger 11 within the wellhead 10, and the helical slot or groove 80 terminates in a tubing hanger orientation slot 81.

One illustrative method of using the tubing hanger 40A with helical slot or groove 80 formed on the inside of the uppermost casing hanger 11 involves the following steps. Initially, the wellhead 10 (i.e., high-pressure housing) may be landed and locked within the conductor pipe 85 without regard to the orientation of the wellhead 10. Thereafter, the casing hanger 11 may be landed and locked within the wellhead 10 without regard to the orientation of the casing hanger 11. At that point, the as-installed orientation or heading of the tubing hanger orientation slot 81 is measured or determined using any of a variety of different techniques. With the as-installed orientation of the tubing hanger orientation slot 81 in the casing 11 now known, the fixed key 69 may be positioned in one of the tubing hanger orientation slots 17 in the tubing hanger 40A while the tubing hanger 40A is at the surface on a vessel or platform, i.e., prior to running the tubing hanger 40A into the well. As before, the precise tubing hanger orientation slot 17 selected for insertion of the fixed key 69 will be determined such that, when the fixed key 69 on the tubing hanger 40A is engaged with the tubing hanger orientation slot 81 in the casing 11, the tubing hanger 40A will be oriented radially in a desired position such that, when the production tree is coupled to the tubing hanger 40A, the production outlet of the production tree will be oriented at the desired target orientation for the production outlet.

The tubing hanger 40A is attached to a tubing hanger running tool and run into the well through the BOP. As the tubing hanger 40A moves further downward within the casing hanger 11, due to the interaction between the helical groove 80 and the fixed key 69, the tubing hanger 40A self-rotates until such time as the fixed key 69 is aligned with the tubing hanger orientation slot 81. At that time, the tubing hanger 40A moves further downward until such time as the tubing hanger 40A lands on the surface 11A of the casing hanger 11. In this position, the fixed key 69 is in its final position within the tubing hanger orientation slot 81. At that point, the orientation of the tubing hanger 40A is fixed with respect to the as-installed orientation of the casing hanger 11.

Figure 18:
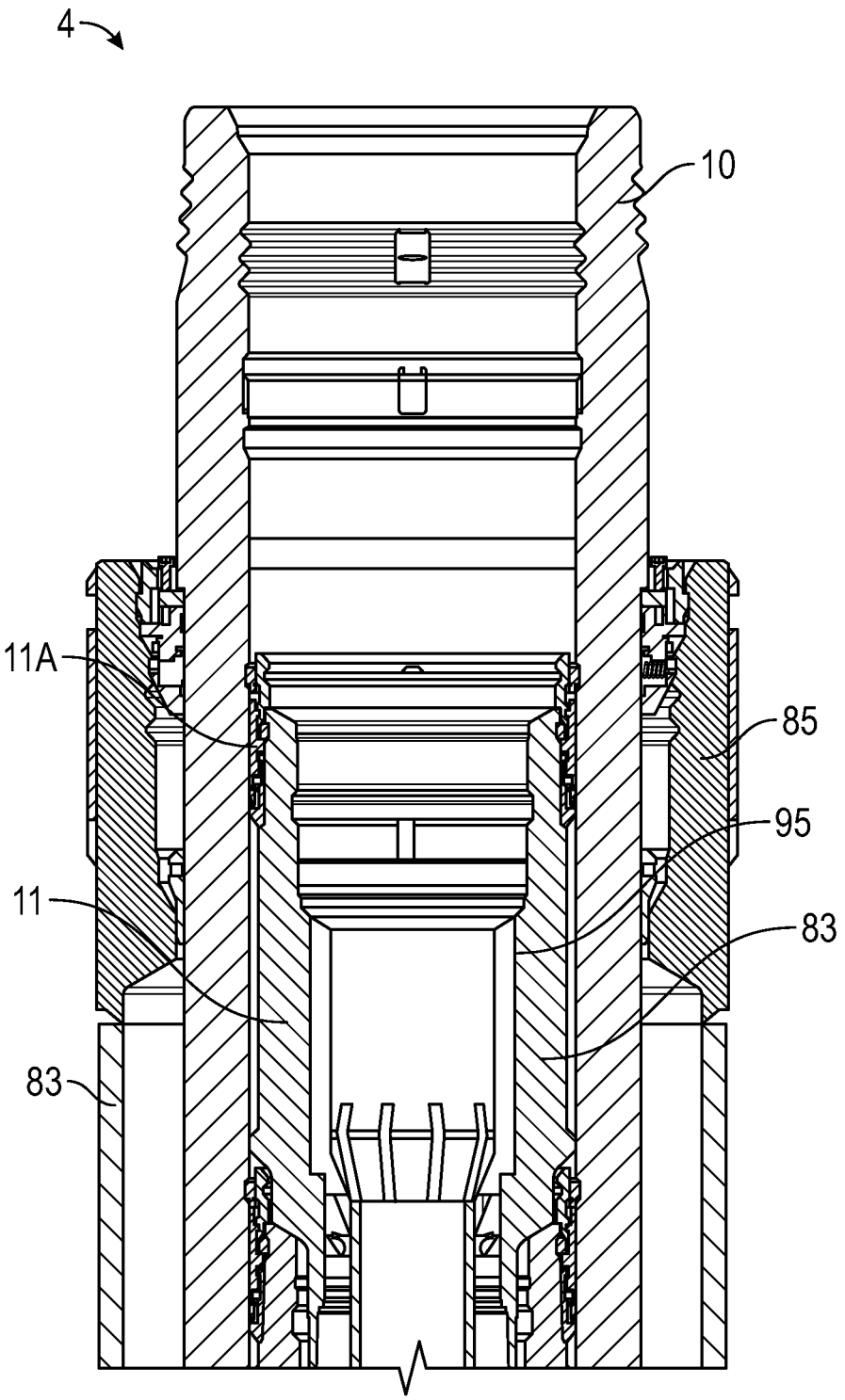
Figure 19:
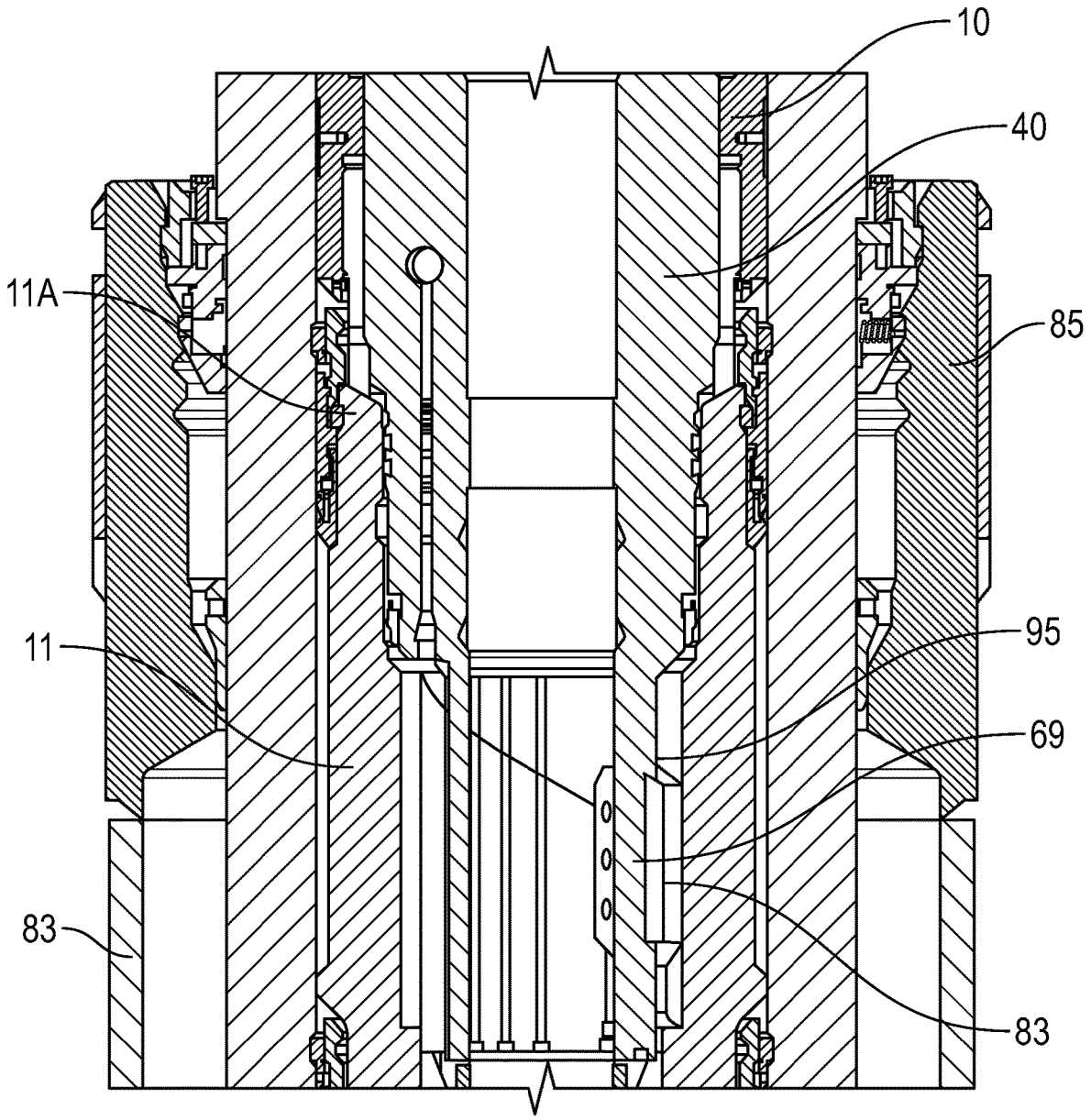

FIGS. 18-19 depict other novel systems, devices and methods for orienting a production outlet of a subsea production tree. In this illustrative embodiment, the wellhead 10 will not be oriented to the field layout prior to installation of the tubing hanger in the wellhead 10. FIGS. 18-19 depict an apparatus 4 wherein a vertically oriented groove 95 has been formed on the inside of the casing hanger 11. In one illustrative embodiment, the groove 95 may be formed such that its long axis is substantially normal or perpendicular to the horizontal. In this example, the upper end of the groove 95 is open. Also depicted in FIG. 18 is the external sensor system 83 (mentioned above and discussed more fully below) that is adapted to sense the location and orientation of the orientation groove 95 after the casing hanger 11 has been positioned and locked within the wellhead 10. In this embodiment, the tubing hanger 40 comprises a fixed key 69 that is adapted to engage the groove 95 when the tubing hanger 40 is positioned in the wellhead 10. As the tubing hanger 40 is positioned within the wellhead 10, the tubing hanger 40 lands on the casing hanger 11. At that point, the tubing hanger running tool rotates the tubing hanger 40 until such time as the fixed key 69 is aligned with the groove 95. Thereafter, the tubing hanger 40 is further lowered into the well wherein the key 69 remains positioned within the groove 95 as the tubing hanger 40 is lowered into the well. In this position, the orientation of the tubing hanger 40 is fixed with respect to the as-installed orientation of the wellhead 10 and the casing hanger 11. After a complete reading of the present application, those skilled in the art will appreciate that the groove 95 could be equally formed in the outer surface of the tubing hanger 40 and the key 69 could be positioned in the inner surface of the wellhead 10. In another illustrative embodiment, where the production tubing hanger is not run into the well immediately after the casing 11 is set in the well, the orientation of the casing hangar 11 could be achieved by using a tool that is run in the well after the BOP is removed. In yet another embodiment, the fixed key 69 may be replaced with a spring-loaded pin 62.

With reference to FIGS. 12 and 18-19, one illustrative method for orienting a production outlet of a subsea production tree using this embodiment will be described. Initially, the conductor pipe 85 and the wellhead 10 are installed in the sea floor 75 without regard to the orientation of ether the conductor pipe 85 or the wellhead 10. Thereafter, a BOP (not shown) is installed on the wellhead 10. Then, a first casing hanger (not shown) is installed in the wellhead without regard to its orientation. Thereafter, the second or uppermost casing hanger 11 is positioned within the wellhead 10. The top drive 70 is then actuated so as to rotate the casing hanger 11 until such time as the sensor system 83 determines that the groove 95 in the casing hanger 11 is at the desired target orientation or heading. At that point, the casing hanger 11 is locked into position within the wellhead 10 so as to set the as-installed orientation of the casing hanger 11, including the groove 95, relative to the overall reference system for the field under development. The as-installed orientation of the casing hanger 11 may then be recorded. Next, the tubing hanger 40 is coupled to a tubing hanger running tool (not shown) and run into the wellhead 10 until the tubing hanger 40 lands on the casing hanger 11. At that point, the tubing hanger running tool rotates the tubing hanger 40 until such time as the fixed key 69 in the tubing hanger 40 is aligned with and engages the groove 95, thereby preventing further rotation of the tubing hanger 40. In this position, the orientation of the tubing hanger 40 is fixed with respect to the as-installed orientation of the wellhead 10. Thereafter, the tubing hanger 40 is locked in position. At that point, the tubing hanger running tool can be unlatched from the tubing hanger 40 and retrieved to the surface. Then, the BOP may be retrieved and a production tree may be installed on the wellhead 10 and coupled to the tubing hanger 40 so as to position the production outlet of the production tree at a desired target orientation relative to the field.

In another embodiment, a tubing hanger 40A (similar to the one depicted in FIG. 13) may be employed with equipment shown in FIGS. 18-19. As noted above, the tubing hanger 40A comprises a plurality of the above-described orientation slots 17 (which are now tubing hanger orientation slots) that are formed in the body of the tubing hanger 40A around the entire outer perimeter of the tubing hanger 40A. In this example, each of the skits 17 is adapted to receive a fixed key 69 (not shown in FIG. 13). In this example, the above-described vertically oriented groove 95 has been formed on the inside of the casing hanger 11.

With reference to FIGS. 12 and 18-19, one illustrative method for orienting a production outlet of a subsea production tree using this embodiment will be described. Initially, the conductor pipe 85 and the wellhead 10 are installed in the sea floor 75 without regard to the orientation of ether the conductor pipe 85 or the wellhead 10. Thereafter, a BOP (not shown) is installed on the wellhead 10. Thereafter, the casing hanger 11 may be landed and locked within the wellhead 10 without regard to the orientation of the casing hanger 11. At that point, the as-installed orientation or heading of the groove 95 is measured or determined using any of a variety of different techniques. With the as-installed orientation of the groove 95 in the casing hanger 11 now known, the fixed key 69 may be positioned in one of the tubing hanger orientation slots 17 in the tubing hanger 40A while the tubing hanger 40A is at the surface on a vessel or platform, i.e., prior to running the tubing hanger 40A into the well. As before, the precise tubing hanger orientation slot 17 selected for insertion of the fixed key 69 will be determined such that, when the fixed key 69 on the tubing hanger 40A is engaged with the groove 95 in the casing hanger 11, the tubing hanger 40A will be oriented radially in a desired position such that, when the production tree is coupled to the tubing hanger 40A, the production outlet of the production tree will be oriented at the desired target orientation for the production outlet.

Next, the tubing hanger 40A is coupled to a tubing hanger running tool (not shown) and run into the wellhead 10 until the tubing hanger 40A lands on the casing hanger 11. At that point, the tubing hanger running tool rotates the tubing hanger 40A until such time as the fixed key 69 in the tubing hanger 40A is aligned with and engages the groove 95. At that point, the tubing hanger 40A is lowered further into the well. Engagement between the fixed key 69 and the groove 95 prevents further rotation of the tubing hanger 40A relative to the casing hanger 11. In this position, the orientation of the tubing hanger 40A is fixed with respect to the as-installed orientation of the groove 95 in the casing hanger 11. Thereafter, the tubing hanger 40A is locked in position. At that point, the tubing hanger running tool can be unlatched from the tubing hanger 40A and retrieved to the surface. Then, the BOP may be retrieved and a production tree may be installed on the wellhead 10 and coupled to the tubing hanger 40A so as to position the production outlet of the production tree at a desired target orientation relative to the field.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. An apparatus, comprising:

a tubing hanger comprising a body and a bore extending through the body;

a plurality of orientation slots positioned around an outside perimeter of the body; and an orientation key positioned in one of the orientation slots.

2. The apparatus of claim 1, further comprising a wellhead, the wellhead comprising a helical groove formed on an inner surface of the wellhead and an orientation slot positioned at a bottom of the helical groove, wherein the orientation key is adapted to engage the helical groove and be positioned in the orientation slot.

3. The apparatus of claim 1, further comprising a wellhead, the wellhead comprising a vertically oriented groove formed on an inner surface of the wellhead, and wherein the orientation key is adapted to engage the vertically oriented groove.

4. The apparatus of claim 1, further comprising a casing hanger, the casing hanger comprising a helical groove formed on an inner surface of the casing hanger and an orientation slot positioned at a bottom of the helical groove, wherein the orientation key is adapted to engage the helical groove and be positioned in the orientation slot.

5. The apparatus of claim 1, further comprising a casing hanger, the casing hanger comprising a vertically oriented groove formed on an inner surface of the casing hanger wherein the orientation key is adapted to engage the vertically oriented groove.

6. The apparatus of claim 1, further comprising an adjustable nut that is threadingly coupled to the exterior of the body of the tubing hanger, the adjustable nut having a bottom surface that is adapted to land on a component previously positioned in the wellhead.

7. The apparatus of claim 1, wherein the plurality of orientation slots are equally spaced from one another around a perimeter of the body.

8. A method, comprising:

installing a wellhead in a conductor pipe without regard to an orientation of the wellhead with respect to a reference system of a subsea production field, the wellhead comprising an orientation groove formed on an inner surface of the wellhead;

after installing the wellhead in the conductor pipe, determining an as-installed orientation of the wellhead relative to the reference system of the subsea production field;

with a tubing hanger at a surface location, inserting a tubing hanger orientation key into one of a plurality of tubing hanger orientation slots formed around an outer perimeter of a body of the tubing hanger, wherein, when the tubing hanger is landed in the wellhead, the tubing hanger will be oriented such that, when a production tree is coupled to the tubing hanger, a production outlet of the production tree will be oriented at a desired target orientation for the production outlet relative to the reference system of the subsea production field;

running the tubing hanger with the tubing hanger orientation key positioned therein into the wellhead until the tubing hanger orientation key registers with the orientation groove, thereby fixing the orientation of the tubing hanger relative to the as-installed orientation of the wellhead; and operatively coupling the production tree to the tubing hanger so as to position the production outlet of the production tree at the desired target orientation for the production outlet relative to the reference system of the subsea production field.

9. The method of claim 8, wherein determining an as-installed orientation of the wellhead comprises using an ROV to visually observe an orientation of an external marking located on an exterior of the wellhead.

10. The method of claim 8, wherein determining an as-installed orientation of the wellhead comprises determining an orientation of the orientation groove.

11. The method of claim 8 wherein determining an as-installed orientation of the wellhead comprises actuating an external sensor system to determine the as-installed orientation of the wellhead.

12. The method of claim 8, further comprising rotating an adjustable nut that is threadingly coupled to the body of the tubing hanger so as to fix a vertical distance between a bottom surface of the adjustable nut and the orientation key.

13. The method of claim 8, wherein the plurality of orientation slots are equally spaced from one another.

* * * * *